US010868362B2

(12) United States Patent
Yun et al.

(10) Patent No.: US 10,868,362 B2
(45) Date of Patent: Dec. 15, 2020

(54) ANTENNA STRUCTURE AND ELECTRONIC DEVICE COMPRISING ANTENNA

(71) Applicant: Samsung Electronics Co., Ltd., Suwon-si (KR)

(72) Inventors: Sumin Yun, Suwon-si (KR); Sehyun Park, Suwon-si (KR); Myunghun Jeong, Suwon-si (KR); Jehun Jong, Suwon-si (KR); Jaehoon Jo, Suwon-si (KR); Jinwoo Jung, Suwon-si (KR); Jaebong Chun, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/510,209

(22) Filed: Jul. 12, 2019

(65) Prior Publication Data

US 2020/0021015 A1 Jan. 16, 2020

(30) Foreign Application Priority Data

Jul. 13, 2018 (KR) ..... 10-2018-0081419

(51) Int. Cl.
*H01Q 1/38* (2006.01)
*H01Q 21/00* (2006.01)
(Continued)

(52) U.S. Cl.
CPC ..... *H01Q 1/38* (2013.01); *H01Q 9/0407* (2013.01); *H01Q 21/0025* (2013.01);
(Continued)

(58) Field of Classification Search
CPC .. H01Q 21/0025; H01Q 21/24; H01Q 1/2266; H01Q 1/243; H01Q 1/2283;
(Continued)

(56) References Cited

U.S. PATENT DOCUMENTS 6,456,242 B1 * 9/2002 Crawford ..... H01Q 1/2258 343/700 MS
7,265,719 B1 9/2007 Moosbrugger et al.
(Continued)

FOREIGN PATENT DOCUMENTS

JP 2009-065321 A 3/2009
KR 10-2019-0060283 A 6/2019
(Continued)

OTHER PUBLICATIONS

International Search Report dated Nov. 13, 2019; International Appln. No. PCT/KR2019/008634.

*Primary Examiner* — Vibol Tan
(74) *Attorney, Agent, or Firm* — Jefferson IP Law, LLP

(57) ABSTRACT

An electronic device capable of radiating signals toward a plurality of planes is provided, and includes a housing including a first plate and a second plate facing away from the first plate, and an antenna structure positioned in the housing. The antenna structure includes a first printed circuit board (PCB) that includes a first surface facing a first direction, a second PCB that includes a second surface facing a second direction different from the first direction, a flexible PCB (FPCB) that is extended between a first periphery of the first PCB and a second periphery of the second PCB, a first conductive pattern that is formed in the first PCB or on the first surface, a second conductive pattern that is formed in the second PCB or on the second surface, and a wireless communication circuit that is mounted on the first PCB and/or the second PCB.

20 Claims, 19 Drawing Sheets

(51) Int. Cl.

| | |
|---|---|
| ***H01Q 21/24*** | (2006.01) |
| ***H01Q 9/04*** | (2006.01) |
| ***H01Q 21/06*** | (2006.01) |
| *H01Q 1/22* | (2006.01) |
| *H01Q 1/24* | (2006.01) |

(52) U.S. Cl.
CPC ..... *H01Q 21/06* (2013.01); *H01Q 21/065* (2013.01); *H01Q 21/24* (2013.01); *H01Q 1/2266* (2013.01); *H01Q 1/243* (2013.01)

(58) Field of Classification Search
CPC ..... H01Q 9/0407; H01Q 21/20; H01Q 25/00; H01Q 21/065; H01Q 21/28; H01Q 13/22; H01Q 9/0485; H01Q 21/29; H01Q 1/2291; H01Q 9/0414; H01Q 23/49822; H01Q 21/067; H01Q 21/293; H01Q 3/26; H01P 3/12; H01P 5/087
See application file for complete search history.

(56) References Cited

U.S. PATENT DOCUMENTS

| | | | | |
|---|---|---|---|---|
| 9,225,058 | B2 | 12/2015 | Devries et al. | |
| 9,293,816 | B2 * | 3/2016 | Samardzija | H01Q 13/16 |
| 2002/0122006 | A1 | 9/2002 | Crawford | |
| 2008/0001830 | A1 | 1/2008 | Hirai et al. | |
| 2014/0266973 | A1 | 9/2014 | Devries et al. | |
| 2018/0026341 | A1 | 1/2018 | Mow et al. | |
| 2019/0027808 | A1 * | 1/2019 | Mow | H04R 1/025 |
| 2019/0165473 | A1 | 5/2019 | Yun et al. | |
| 2019/0165478 | A1 | 5/2019 | Jo et al. | |
| 2019/0229404 | A1 * | 7/2019 | Xia | H01Q 3/36 |
| 2019/0319341 | A1 * | 10/2019 | Park | H01Q 21/065 |
| 2019/0372229 | A1 * | 12/2019 | Dalmia | H01Q 3/01 |

FOREIGN PATENT DOCUMENTS

| | | | |
|---|---|---|---|
| KR | 10-2019-0061795 | A | 6/2019 |
| KR | 10-2019-0061936 | A | 6/2019 |

* cited by examiner

ANTENNA STRUCTURE AND ELECTRONIC DEVICE COMPRISING ANTENNA

CROSS-REFERENCE TO RELATED APPLICATION(S)

This application is based on and claims priority under 35 U.S.C. § 119(a) of a Korean patent application number 10-2018-0081419, filed on Jul. 13, 2018, in the Korean Intellectual Property Office, the disclosure of which is incorporated by reference herein in its entirety.

BACKGROUND

1. Field

The disclosure relates to an electronic device including an antenna capable of radiating signals toward a plurality of planes.

2. Description of Related Art

For the purpose of satisfying demand on wireless data traffic after commercialization of 4th generation (4G) communications, there is being developed a communication system (e.g., a 5th generation (5G) communication system, a pre-5G communication system, and/or a new radio (NR) system) that transmits/receives a signal by using a frequency of a high-frequency (e.g., a millimeter wave (mmWave)) band (e.g., ranging from 3 GHz to 300 GHz).

An electronic device may include a plurality of communication devices (e.g., an antenna module) for transmitting/receiving a signal in the mmWave band. The loss of a transmission path may be increased due to such a high frequency of the signal of the mmWave band (hereinafter referred to as an "mmWave signal"). For the purpose of reducing the loss of the transmission path, an antenna module (e.g., an antenna structure) where a communication circuit (e.g., a radio frequency integrated circuit (RFIC)) is positioned in an antenna is being researched.

Due to the high directivity of the mmWave signal, a plurality of communication devices may be positioned in an electronic device for the purpose of radiating wireless signals in multiple directions. However, as the number of communication devices increases, a space in a housing of the electronic device may decrease. Also, a shape or an embedding location of an internal component of the electronic device may be restricted due to locations of such communication devices.

The above information is presented as background information only, and to assist with an understanding of the disclosure. No determination has been made, and no assertion is made, as to whether any of the above might be applicable as prior art with regard to the disclosure.

SUMMARY

Aspects of the disclosure are provided to address at least the above-mentioned problems and/or disadvantages, and to provide at least the advantages described below. Accordingly, an aspect of the disclosure is to provide an electronic device including at least one communication device capable of radiating a multi-directional signal.

Additional aspects will be set forth in part in the description which follows and, in part, will be apparent from the description, or may be learned by practice of the presented embodiments.

In accordance with an aspect of the disclosure, an electronic device is provided. The electronic device includes a housing that includes a first plate and a second plate facing away from the first plate, a display configured to be viewable through a portion of the first plate and is positioned in the housing, and an antenna structure that is positioned in the housing. The antenna structure includes a first printed circuit board (PCB) that includes a first surface facing a first direction, a second PCB that includes a second surface facing a second direction different from the first direction, a flexible PCB (FPCB) that is extended between a first periphery of the first PCB and a second periphery of the second PCB, at least one first conductive pattern that is formed in the first PCB or on the first surface, at least one second conductive pattern that is formed in the second PCB or on the second surface, at least one wireless communication circuit that is mounted on the first PCB and/or the second PCB and transmits and/or sends a signal having a frequency between 3 GHz and 100 GHz, and at least one third conductive pattern that is disposed in the FPCB and is electrically connected with the at least one wireless communication circuit.

In accordance with another aspect of the disclosure, another electronic device is provided. The electronic device includes a housing that includes a first plate, a second plate facing away from the first plate, and a side member surrounding a space between the first plate and the second plate and connected with the second plate or integrally formed with the second plate, a display configured to be visually exposed through a portion of the first plate and is positioned in the housing, and an antenna structure that is positioned in the housing. The antenna structure includes a first planar structure that faces the second plate, the first planar structure including a plurality of first conductive plates formed therein or thereon, a connection part which includes a first end bent and extended toward the side member from one end of the first planar structure, the connection part including at least one third conductive plate formed therein or thereon, a second planar structure that faces the side member and is connected with a second end of the connection part which is opposite to the first end, the second planar structure including a plurality of second conductive plates formed therein or thereon, and at least one wireless communication circuit that is electromagnetically connected with the plurality of first conductive plates, the plurality of second conductive plates, and the at least one third conductive plate and transmits or receives a signal having a frequency between 3 GHz and 100 GHz.

In accordance with another aspect of the disclosure, another electronic device is provided. The electronic device includes a housing that forms an exterior of the electronic device and includes a front surface, a back surface facing away from the front surface, and a side surface surrounding at least a portion of a space between the front surface and the back surface, and a communication device that includes a first antenna array disposed to face the back surface, a second antenna array disposed to face the side surface, and a third antenna element group interposed between the first antenna array and the second antenna array and is formed in a shape of a curve having at least one curvature. The first antenna array includes a plurality of first antenna elements, the second antenna array includes a plurality of second antenna elements, and the third antenna element group includes at least one third antenna element.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

The following description with reference to the accompanying drawings is provided to assist in a comprehensive understanding of various embodiments of the disclosure as defined by the claims and their equivalents. It includes various specific details to assist in that understanding, but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but are merely used to enable a clear and consistent understanding of the disclosure. Accordingly, it should be apparent to those skilled in the art that the following description of various embodiments of the disclosure is provided for illustration purpose only, and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 1:
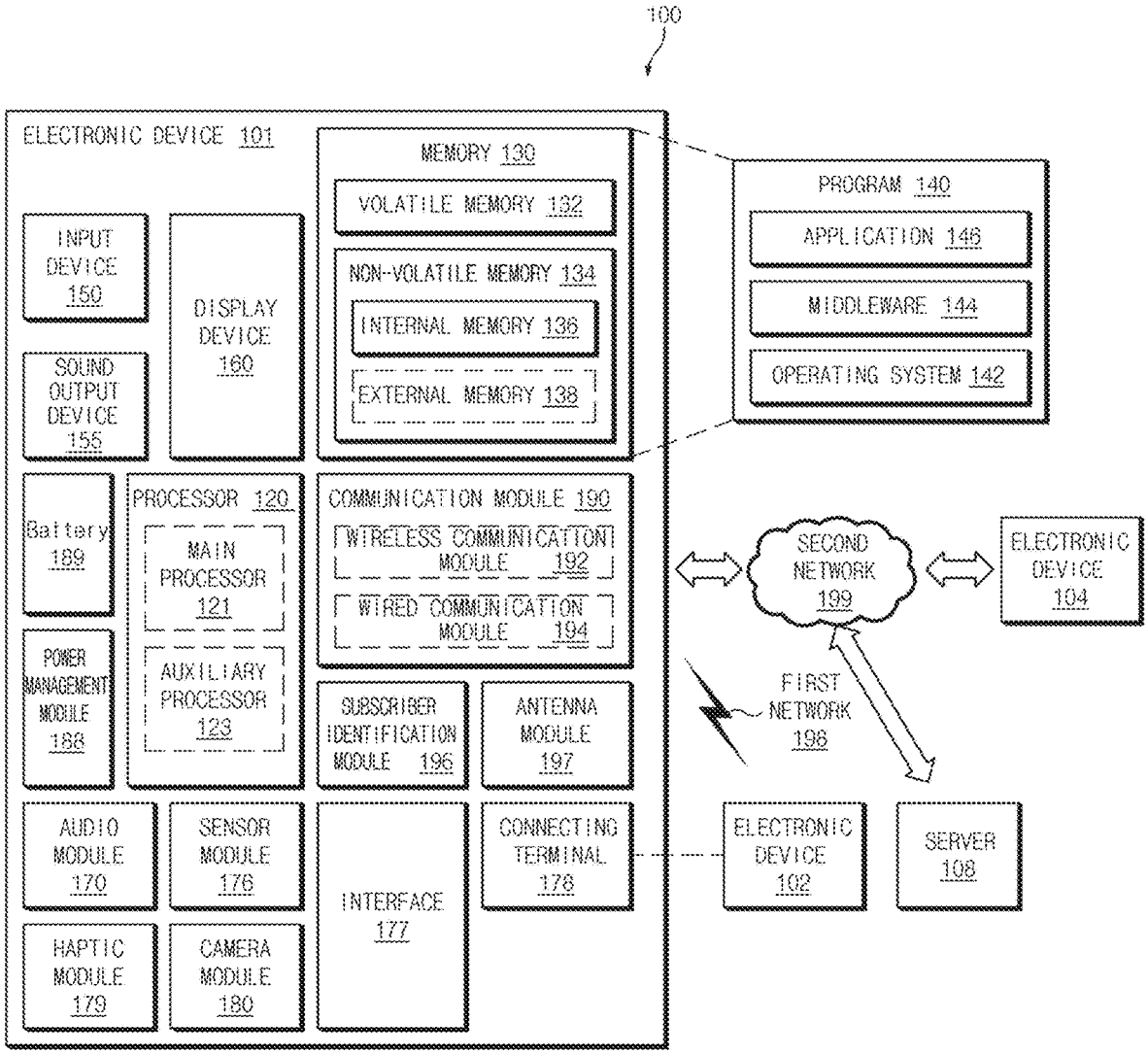
FIG. 1 illustrates a block diagram of an electronic device in a network environment according to an embodiment of the disclosure.

FIG. 1 is a block diagram illustrating an electronic device in a network environment according to an embodiment of the disclosure.

Referring to FIG. 1, an electronic device 101 in a network environment 100 may communicate with another electronic device 102 via a first network 198 (e.g., a short-range wireless communication network), or another electronic device 104 or a server 108 via a second network 199 (e.g., a long-range wireless communication network). According to an embodiment, the electronic device 101 may also communicate with the electronic device 104 via the server 108. According to an embodiment, the electronic device 101 may include a processor 120, memory 130, an input device 150, a sound output device 155, a display device 160, an audio module 170, a sensor module 176, an interface 177, a haptic module 179, a camera module 180, a power management module 188, a battery 189, a communication module 190, a subscriber identification module (SIM) 196, or an antenna module 197. In some embodiments, at least one (e.g., the display device 160 or the camera module 180) of the components may be omitted from the electronic device 101, or one or more other components may be added in the electronic device 101. In some embodiments, some of the components may be implemented as single integrated circuitry. For example, the sensor module 176 (e.g., a fingerprint sensor, an iris sensor, or an illuminance sensor) may be implemented as embedded in the display device 160 (e.g., a display).

The processor 120 may execute, for example, software (e.g., a program 140) to control at least one other component (e.g., a hardware or software component) of the electronic device 101 coupled with the processor 120, and may perform various data processing or computation. According to one embodiment, as at least part of the data processing or computation, the processor 120 may load a command or data received from another component (e.g., the sensor module 176 or the communication module 190) in volatile memory 132, process the command and/or data stored in the volatile memory 132, and store resulting data in non-volatile memory 134. According to an embodiment, the processor 120 may include a main processor 121 (e.g., a central processing unit (CPU) or an application processor (AP)), and an auxiliary processor 123 (e.g., a graphics processing unit (GPU), an image signal processor (ISP), a sensor hub processor, or a communication processor (CP)) that is operable independently from, or in conjunction with, the main processor 121. Additionally or alternatively, the auxiliary processor 123 may be adapted to consume less power than the main processor 121, or to be specific to a specified function. The auxiliary processor 123 may be implemented as separate from, or as part of the main processor 121.

The auxiliary processor 123 may control at least some of the functions or states related to at least one component (e.g., the display device 160, the sensor module 176, or the communication module 190) among the components of the electronic device 101, instead of the main processor 121 while the main processor 121 is in an inactive (e.g., sleep) state, or together with the main processor 121 while the main processor 121 is in an active state (e.g., executing an application). According to an embodiment, the auxiliary processor 123 (e.g., an image signal processor or a communication processor) may be implemented as part of another component (e.g., the camera module 180 or the communication module 190) functionally related to the auxiliary processor 123.

The memory 130 may store various data used by at least one component (e.g., the processor 120 or the sensor module 176) of the electronic device 101. The various data may include, for example, software (e.g., the program 140) and input data or output data for a command related thereto. The memory 130 may include the volatile memory 132 or the non-volatile memory 134, and the non-volatile memory 134 may include an internal memory 136 and/or an external memory 138.

The program 140 may be stored in the memory 130 as software, and may include, for example, an operating system (OS) 142, middleware 144, and/or an application 146.

The input device 150 may receive a command or data to be used by other components (e.g., the processor 120) of the electronic device 101, from the outside (e.g., a user) of the electronic device 101. The input device 150 may include, for example, a microphone, a mouse, or a keyboard.

The sound output device 155 may output sound signals to the outside of the electronic device 101. The sound output device 155 may include, for example, a speaker or a receiver. The speaker may be used for general purposes, such as playing multimedia or playing recordings, and the receiver may be used for incoming calls. According to an embodiment, the receiver may be implemented as separate from, or as part of the speaker.

The display device 160 may visually provide information to the outside (e.g., a user) of the electronic device 101. The display device 160 may include, for example, a display, a hologram device, or a projector and control circuitry to control a corresponding one of the display, hologram device, and projector. According to an embodiment, the display device 160 may include touch circuitry adapted to detect a touch, gesture or hovering, and/or sensor circuitry (e.g., a pressure sensor) adapted to measure the intensity of force incurred by the touch or gesture.

The audio module 170 may convert a sound into an electrical signal and may convert an electrical signal into a sound or sounds. According to an embodiment, the audio module 170 may obtain the sound via the input device 150, or output the sound via the sound output device 155 or a headphone of an external electronic device (e.g., an electronic device 102) directly (e.g., wiredly) or wirelessly coupled with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. According to an embodiment, the sensor module 176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device (e.g., the electronic device 102) directly (e.g., wiredly) or wirelessly. According to an embodiment, the interface 177 may include, for example, a high definition multimedia interface (HDMI), a universal serial bus (USB) interface, a secure digital (SD) card interface, or an audio interface.

A connecting terminal 178 may include a connector via which the electronic device 101 may be physically connected with the external electronic device (e.g., the electronic device 102). According to an embodiment, the connecting terminal 178 may include, for example, an HDMI connector, a USB connector, an SD card connector, or an audio connector (e.g., a headphone connector), The haptic module 179 may convert an electrical signal into a mechanical stimulus (e.g., a vibration or a movement) or electrical stimulus which may be recognized by a user via tactile sensation or kinesthetic sensation. According to an embodiment, the haptic module 179 may include, for example, a motor, a piezoelectric element, or an electric stimulator.

The camera module 180 may capture a still image or moving images. According to an embodiment, the camera module 180 may include one or more lenses, image sensors, image signal processors, or flashes.

The power management module 188 may manage power consumed by or supplied to the electronic device 101. According to one embodiment, the power management module 188 may be implemented as at least part of, for example, a power management integrated circuit (PMIC).

The battery 189 may supply power to at least one component of the electronic device 101. According to an embodiment, the battery 189 may include, for example, a primary cell which is not rechargeable, a secondary cell which is rechargeable, or a fuel cell, or a combination thereof.

The communication module 190 may support establishing a direct (e.g., wired) communication channel or a wireless communication channel between the electronic device 101 and the external electronic device (e.g., the electronic device 102, the electronic device 104, or the server 108) and performing communication via the established communication channel. The communication module 190 may include one or more communication processors that are operable independently from the processor 120 (e.g., the application processor (AP)) and supports a direct (e.g., wired) communication or a wireless communication. According to an embodiment, the communication module 190 may include a wireless communication module 192 (e.g., a cellular communication module, a short-range wireless communication module, or a global navigation satellite system (GNSS) communication module) and/or a wired communication module 194 (e.g., a local area network (LAN) communication module or a power line communication (PLC) module). A corresponding one of these communication modules may communicate with the external electronic devices via the first network 198 (e.g., a short-range communication network, such as Bluetooth™ wireless-fidelity (Wi-Fi) direct, or infrared data association (IrDA)) or the second network 199 (e.g., a long-range communication network, such as a cellular network, the Internet, or a computer network (e.g., LAN or wide area network (WAN)). These various types of communication modules may be implemented as a single component (e.g., a single chip), or may be implemented as multi-components (e.g., multi-chips) separate from each other. The wireless communication module 192 may identify and authenticate the electronic device 101 in a communication network, such as the first network 198 or the second network 199, using subscriber information (e.g., international mobile subscriber identity (IMSI)) stored in the subscriber identification module 196.

The antenna module 197 may transmit or receive a signal or power to or from the outside (e.g., the external electronic device) of the electronic device 101. According to an embodiment, the antenna module 197 may include one or more antennas, and, therefrom, at least one antenna appropriate for a communication scheme used in the communication network, such as the first network 198 or the second network 199, may be selected, for example, by the communication module 190 (e.g., the wireless communication module 192). The signal or the power may then be transmitted or received between the communication module 190 and the external electronic device via the selected at least one antenna.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 101 and the external electronic device 104 via the server 108 coupled with the second network 199. Each of the electronic devices 102 and 104 may be a device of a same type as, or a different type, from the electronic device 101. According to an embodiment, all or some of operations to be executed at the electronic device 101 may be executed at one or more of the external electronic devices 102, 104, and/or 108. For example, if the electronic device 101 is to perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To that end, cloud computing, distributed computing, or client-server computing technology may be used, for example.

Figure 2:
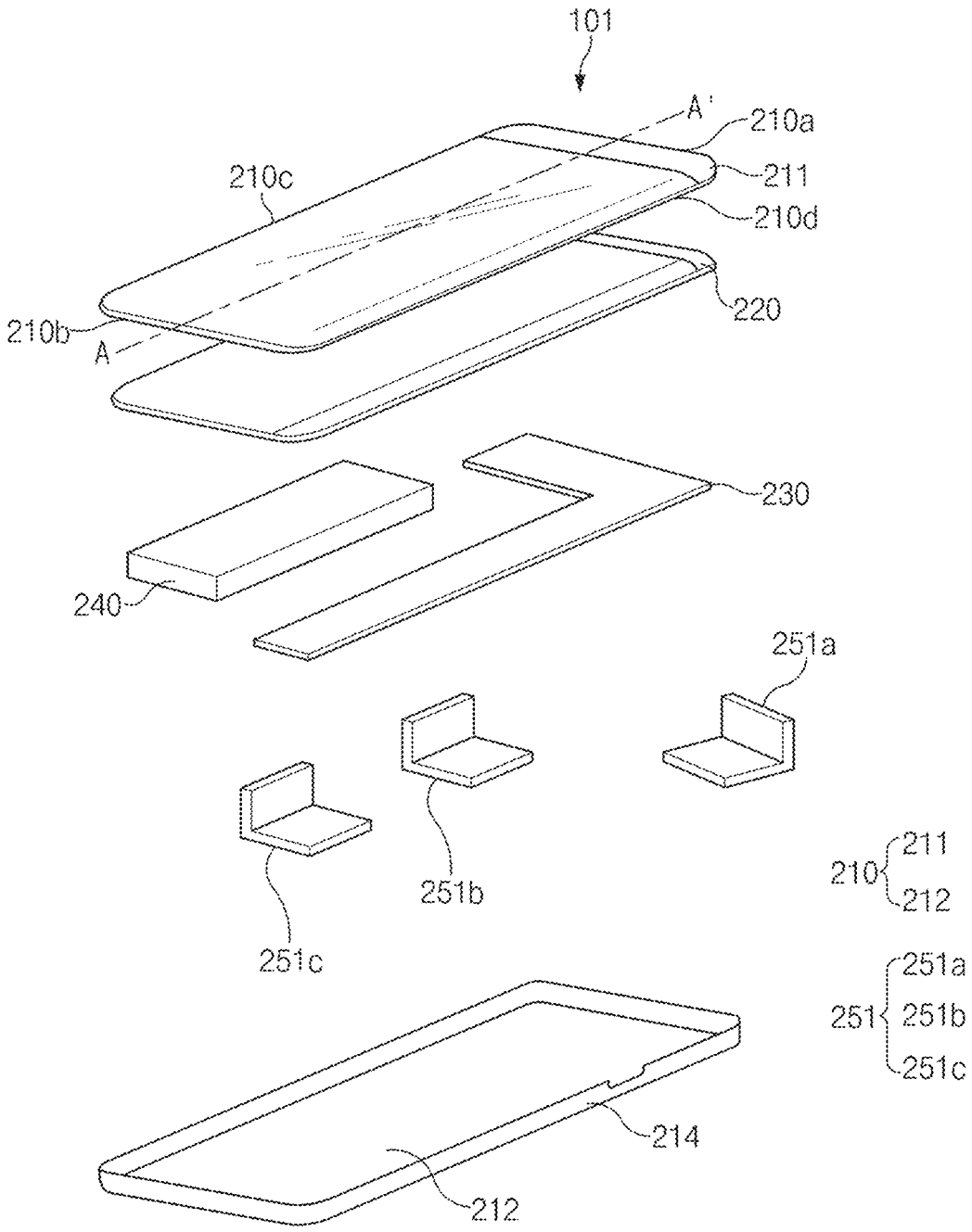
FIG. 2 illustrates an exploded perspective view of an electronic device according to an embodiment of the disclosure.

FIG. 2 illustrates an exploded perspective view of an electronic device according to an embodiment of the disclosure.

Referring to FIG. 2, the electronic device 101 (e.g., the electronic device 101 of FIG. 1) may include a cover glass 211, a back cover 212, a display 220, a printed circuit board (PCB) 230, a battery 240, and/or a communication device 251.

According to an embodiment, the cover glass 211 and the back cover 212 may be coupled with each other to form a housing 210 of the electronic device 101. The housing 210 may form the exterior of the electronic device 101, and may protect internal components of the electronic device 101 from external impact.

According to an embodiment, the housing 210 may include a front surface, a back surface facing away from the front surface, and a side surface surrounding a space between the front surface and the back surface. In an embodiment, the side surface may include a first side surface (e.g., a peripheral region forming 210*a*, 210*b*, 210*c*, and 210*d*) and a second side surface 214.

According to an embodiment, a shape of the housing 210 may correspond to at least one of a rectangle, substantially a rectangle, a circle, or an ellipse, when viewed from the front surface. For example, the housing 210 may be in the shape of a rectangle or substantially a rectangle (e.g., a rectangle having one or more curved corners) including the first edge 210*a*, the second edge 210*b* opposite to the first edge 210*a*, the third edge 210*c* connecting one end of the first edge 210*a* and one end of the second edge 210*b*, and the fourth edge 210*d* connecting an opposite end of the first edge 210*a* and an opposite end of the second edge 210*b*, when viewed from the front surface. According to an embodiment, as illustrated in FIG. 2, the cover glass 211 may form a substantially flat front surface of the electronic device 101 and the first side surface extended from the front surface, and the back cover 212 may form the back surface of the electronic device 101 and the second side surface 214 extended from the back surface. According to another embodiment, the cover glass 211 may form a substantially flat front surface of the electronic device 101, and the back cover 212 may form the back surface and the side surface of the electronic device 101. In this case, according to an embodiment, the side surface may form a first portion (e.g., the second side surface 214) extended from the back surface and a second portion (e.g., the first side surface) extended from the first portion, and at least a portion of the second portion may be bent in a different direction from the first portion and may be coupled with the front surface.

According to an embodiment, at least a portion of the first side surface and the second side surface 214 may be formed of a conductor. For example, the conductor may include aluminum (Al), or a metal material such as stainless steel. In this case, at least a portion of the first side surface and the second side surface 214 may be formed of a metal frame that is distinguished from the front surface or the back surface of the housing 210, for example. For example, the housing 210 may include the cover glass 211 corresponding to the front surface, the back cover 212 corresponding to the back surface, and the metal frame corresponding to the side surface.

According to an embodiment, at least a portion of the cover glass 211 and the back cover 212 may be formed of a dielectric material having permittivity of a specified strength. For example, the permittivity of the dielectric material forming the cover glass 211 and the permittivity of the dielectric material forming the back cover 212 may be equal, or may be at least partially different.

According to an embodiment, the display 220 (e.g., the display device 160 of FIG. 1) may be interposed between the cover glass 211 and the back cover 212. The display 220 may be electrically connected with the printed circuit board 230, and may output content (e.g., a text, an image, a video, an icon, a widget, a symbol, or the like) or may receive a touch input (e.g., a touch, a gesture, a hovering, or the like) from the user.

According to an embodiment, various electronic parts, elements, or printed circuits of the electronic device 101 may be mounted on the printed circuit board 230. For example, an application processor (AP) (e.g., the processor 120 of FIG. 1), a communication processor (CP) (e.g., the processor 120 of FIG. 1), or a memory (e.g., the memory 130 of FIG. 1) may be mounted on the printed circuit board 230. In various embodiments of the disclosure, the printed circuit board 230 may be referred to as a "first PCB", a "main PCB", a "main board", or a "printed board assembly (PBA)".

According to an embodiment, the battery 240 (e.g., the battery 189 of FIG. 1) may convert chemical energy and electrical energy bidirectionally. For example, the battery 240 may convert chemical energy into electrical energy and may supply the converted electrical energy to the display 220 and various components or modules mounted on the printed circuit board 230. As another example, the battery 240 may convert electrical energy supplied from the outside into chemical energy and may store the converted electrical energy (recharge). According to an embodiment, the printed circuit board 230 may include a power management module (e.g., the power management module 188 of FIG. 1) for managing the charging and discharging of the battery 240.

According to an embodiment, the communication device 251 may be interposed between the display 220 and the back cover 212. According to an embodiment, the communication device 251 may mean a module that includes at least one antenna array for radiating a signal in a high-frequency band (e.g., ranging from 3 GHz to 300 GHz). Components included in the communication device 251 will be described with reference to FIG. 4. For example, each of a plurality of communication devices 251*a*, 251*b*, and 251*c* may be referred to as the "communication device 251". According to an embodiment, at least a part of the plurality of communication devices 251*a*, 251*b*, and 251*c* may be disposed next to the printed circuit board 230 or may be interposed between the printed circuit board 230 and the back cover 212. According to an embodiment, at least a part of the plurality of communication devices 251*a*, 251*b*, and 251*c* may be attached to the back cover 212 by a coupling means (e.g., an adhesive or a fastening structure (e.g., a bolt and nut)). According to an embodiment, at least a part of the plurality of communication devices 251*a*, 251*b*, and 251*c* may be included in the printed circuit board 230. For example, at least a part of the plurality of communication devices 251*a*, 251*b*, and 251*c* may be implemented as at least a portion of the printed circuit board 230.

The layout, shapes (e.g., a size and/or a shape), and the number of the plurality of communication devices 251*a*, 251*b*, and 251*c* illustrated in FIG. 2 are not limited to the example illustrated in FIG. 2.

According to an embodiment, the electronic device 101 may further include a communication module (not illustrated) (e.g., the communication module 190 of FIG. 1) on the printed circuit board 230. The communication module may include a baseband processor (BP), a radio frequency integrated circuit (RFIC), or an intermediate frequency integrated circuit (IFIC). According to an embodiment, the communication module may be electrically connected with the communication device 251 and may feed power to the communication device 251. In various embodiments of the disclosure, the term "feed" or "feeding" may mean an operation in which the communication module applies a current to the communication device 251. In an embodiment, the communication module may communicate with an external device (e.g., the electronic device 102, the electronic device 104, or the server 108 of FIG. 1) through a millimeter wave signal by feeding power to the communication device 251. The millimeter wave signal may be understood, for example, as a signal, a wavelength of which is in units of millimeter, or as a signal having a frequency of a band, for example, ranging from 3 GHz to 100 GHz.

Figure 3:
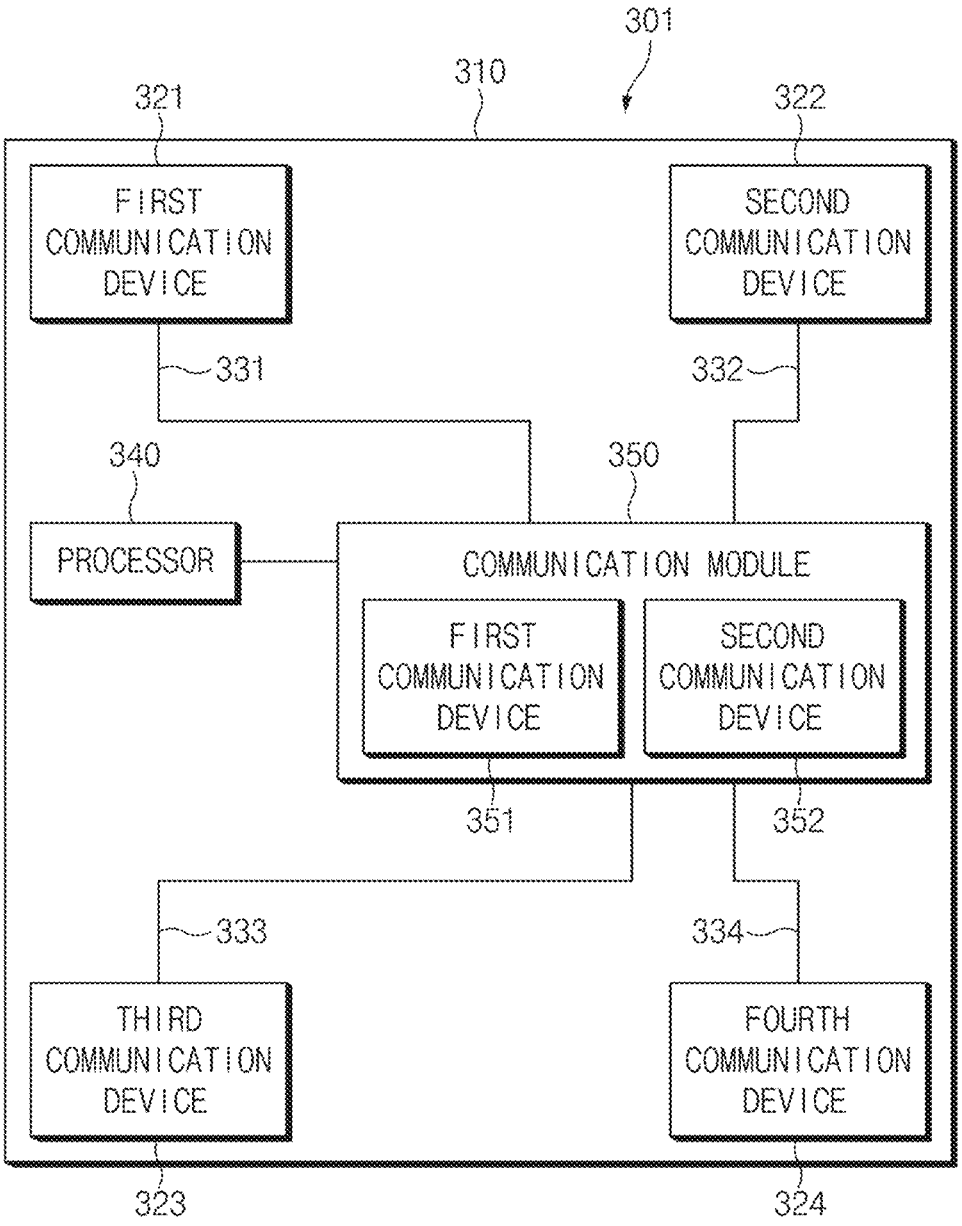
FIG. 3 illustrates a block diagram of a communication system supporting 5th generation (5G) communication according to an embodiment of the disclosure.

FIG. 3 illustrates a block diagram of an electronic device supporting 5th generation (5G) communication according to an embodiment of the disclosure.

Referring to FIG. 3, an electronic device 301 (e.g., the electronic device 101 of FIG. 2) may include at least one of a housing 310 (e.g., the housing 210 of FIG. 2), a processor 340 (e.g., the processor 120 of FIG. 1), a communication module 350 (e.g., the communication module 190 of FIG. 1), a first communication device 321, a second communication device 322, a third communication device 323, a fourth communication device 324 (hereinafter, at least one of the communication devices 251*a*, 251*b*, and 251*c* of FIG. 2), a first conductive line 331, a second conductive line 332, a third conductive line 333, and/or a fourth conductive line 334.

According to an embodiment, the housing 310 (e.g., the cover glass 211 and the back cover 212) may protect other components of the electronic device 301. The housing 310 may include, for example, a front plate (e.g., a first plate) (e.g., the cover glass 211 of FIG. 2), a back plate (e.g., a second plate) (e.g., the back cover 212 of FIG. 2) facing away from the front plate, and a side member (e.g., the first side surface (210*a*, 210*b*, 210*c*, 210*d*) and/or the second side surface 214 of FIG. 2) (or a metal frame) surrounding a space between the front plate and the back plate. The side member may be attached to the back plate or may be integrally formed with the back plate. For example, a display (e.g., the display 220 of FIG. 2) may be exposed through a portion of the front plate and may be positioned in the housing 310.

According to an embodiment, the electronic device 301 may include at least one of the first communication device 321, the second communication device 322, the third communication device 323, or the fourth communication device 324. For example, a communication device may be called an "antenna structure".

According to an embodiment, the processor 340 may include one or more of a central processing unit, an application processor (AP), a graphic processing unit (GPU), an image signal processor of a camera, or a baseband processor (BP) (or a communication processor (CP)). According to an embodiment, the processor 340 may be implemented with a system on chip (SoC) or a system in package (SiP).

According to an embodiment, the communication module 350 may be electrically connected with at least one of the first communication device 321, the second communication device 322, the third communication device 323, or the fourth communication device 324 by using at least one of the first conductive line 331, the second conductive line 332, the third conductive line 333, or the fourth conductive line 334. For example, the communication module 350 may be electrically connected with the first communication device 321, the second communication device 322, the third communication device 323, and/or the fourth communication device 324 by using the first conductive line 331, the second conductive line 332, the third conductive line 333, and/or the fourth conductive line 334. The communication module 350 may include at least one of a BP, an RFIC, or an IFIC.

According to an embodiment, the communication module 350 may include a processor (e.g., a BP) that is independent of the processor 340 (e.g., an AP). For example, in the case where the processor 340 includes an AP and the communication module 350 includes the BP, the electronic device 301 may further include an RFIC and/or an IFIC as a separate module (not illustrated). In this case, the RFIC or the IFIC may be electrically connected with the communication module 350, and the RFIC or the IFIC may be electrically connected with the first communication device 321, the second communication device 322, the third communication device 323, and/or the fourth communication device 324 by using the first conductive line 331, the second conductive line 332, the third conductive line 333, and/or the fourth conductive line 334. For another example, the BP and the RFIC and/or IFIC may be integrally formed with the one communication module 350. According to another embodiment, the processor 340 may include an AP and a BP, and the communication module 350 may include an IFIC or an RFIC.

The first conductive line 331, the second conductive line 332, the third conductive line 333, and/or the fourth conductive line 334 may include, for example, a coaxial cable and/or a flexible printed circuit board (FPCB).

According to an embodiment, the communication module 350 may include at least one of a first communication module 351 (e.g., a first BP) and a second communication module 352 (e.g., a second BP). The electronic device 301 may further include at least one interface (e.g., an inter processor communication channel) for supporting inter-chip communication between the first communication module 351 (e.g., the first BP) or the second communication module 352 (e.g., the second BP) and the processor 340. The processor 340 and the first communication module 351 or the second communication module 352 may transmit or receive data by using the at least one interface.

According to an embodiment, the first communication module 351 and/or the second communication module 352 may provide an interface for performing communication with any other entities. The first communication module 351 may support, for example, wireless communication with regard to a first network (not illustrated). The second communication module 352 may support, for example, wireless communication with regard to a second network (not illustrated).

According to an embodiment, the first communication module 351 and/or the second communication module 352 may form one module with the processor 340. For example, the first communication module 351 or the second communication module 352 may be integrally formed with the processor 340.

According to an embodiment, the communication module 350 may be implemented with a single communication module (e.g., a BP). For example, the communication module 350 may include one communication module capable of supporting wireless communication with regard to the first network and the second network.

As another example, the first communication module 351 and/or the second communication module 352 may be disposed in one chip or may be implemented in the form of an independent chip. According to an embodiment, the processor 340 and at least one BP (e.g., the first communication module 351) may be integrally formed in one chip (e.g., a SoC), and the other BP (e.g., the second communication module 352) may be implemented in the form of an independent chip.

According to an embodiment, the communication devices 321, 322, 323, or 324 may up-convert or down-convert a frequency. For example, the first communication device 321 may up-convert an intermediate frequency (IF) signal received through the first conductive line 331. As another example, the first communication device 321 may down-convert a mmWave signal received through an antenna array (not illustrated), and may transmit the down-converted signal by using the first conductive line 331. According to an embodiment, through the conductive lines 331, 332, 333, or 334, the communication devices 321, 322, 323, or 324 may provide a signal directly to the processor 340 or may receive a signal directly from the processor 340. For example, the communication module 350 may be omitted or may be integrated in the processor 340.

For example, the operations of the communication module 350 described in the disclosure may be performed by the processor 340 and/or the communication devices 321, 322, 323, or 324.

According to an embodiment, the first network (not illustrated) or the second network (not illustrated) may correspond to the network 199 of FIG. 1. According to an embodiment, the first network (not illustrated) and the second network (not illustrated) may include a 4G network and a 5G network, respectively. The 4G network may support a long-term evolution (LTE) protocol or an LTE-advanced (LTE-A) protocol defined in the 3rd generation partnership project (3GPP). The 5G network may support, for example, a new radio (NR) protocol defined in the 3GPP.

Figure 4:
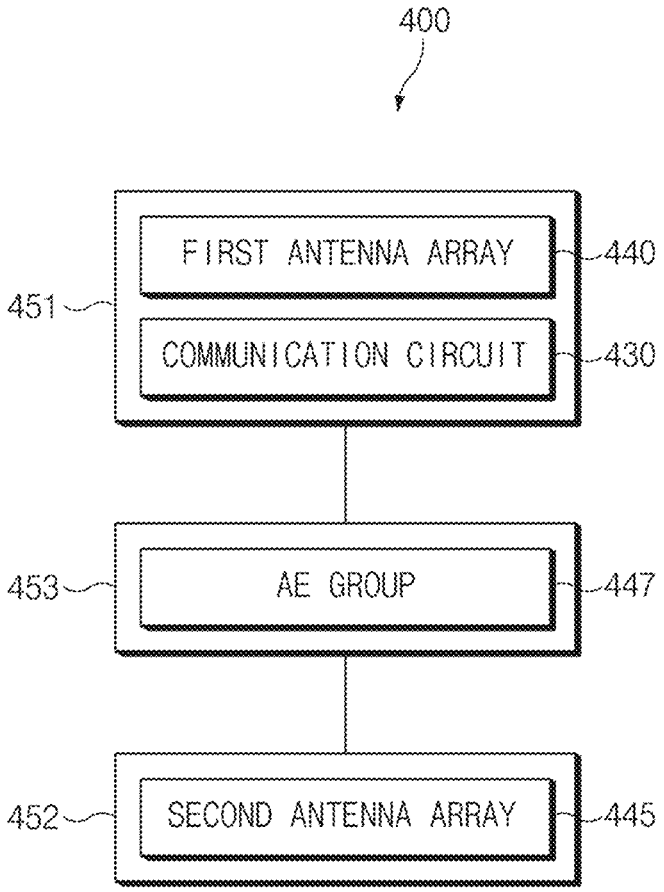
FIG. 4 illustrates a block diagram of a communication device according to an embodiment of the disclosure.

FIG. 4 illustrates a block diagram of a communication device according to an embodiment of the disclosure.

Referring to FIG. 4, a communication device 400 (e.g., the first communication device 321, the second communication device 322, the third communication device 323, and/or the fourth communication device 324 of FIG. 3) may include a first printed circuit board (PCB) 451, a communication circuit 430 (e.g., an RFIC) disposed on the first PCB 451, a first antenna array 440 disposed on the first PCB 451, a second PCB 452, a second antenna array 445 disposed on the second PCB 452, a connection part 453, and/or an antenna element (AE) group 447 positioned at the connection part 453. The communication device 400 may be referred to as an "antenna module", "an antenna structure", or "a radio frequency antenna (RFA) module".

According to various embodiments, the first PCB 451 may include a coaxial cable connector or a board to board (B-to-B) connector for electrical connection with any other PCB (e.g., a PCB on which the communication module 350 of FIG. 3 is disposed) by using a transmission line (e.g., the conductive lines 331, 332, 333, or 334 of FIG. 3 and/or a coaxial cable). For example, the first PCB 451 may be connected with the PCB, on which the communication module 350 is disposed, with a coaxial cable by using a coaxial cable connector, and the coaxial cable may be used to transfer a radio frequency (RF) signal or a transmit and receive intermediate frequency (IF) signal. As another example, power or any other control signal may be provided through the B-to-B connector. The first PCB 451 may be electromagnetically coupled with the second PCB 452 through the connection part 453.

According to various embodiments, the connection part 453 may be a flexible PCB (FPCB). According to an embodiment, the first antenna array 440 may be disposed on a first surface (e.g., a first side) of the first PCB 451, and the second antenna array 445 may be disposed on a second surface of the second PCB 452. For example, the first surface and the second surface may not be parallel to each other. As another example, the connection part 453 may be formed such that the first surface and the second surface make a specified angle (e.g., about 10 degrees or more and less than about 170 degrees). According to an embodiment, when the communication device 400 is mounted inside a housing (e.g., the housing 210 of FIG. 2), the first surface may be positioned to face a back surface (e.g., the back plate 212) of the housing, and the second surface may be positioned to face the second side surface 214 of the housing. According to an embodiment, the first surface may be substantially perpendicular to the second surface.

According to an embodiment, the connection part 453 may be different from the first PCB 451 and the second PCB 452 in at least one of thickness, number of layers, curvature, materials, width, direction to which a surface faces, and/or property of matter. For example, the connection part 453 may be smaller in thickness than the first PCB 451 and the second PCB 452. As another example, the number of layers of the connection part 453 may be smaller than the number of layers of each of the first PCB 451 and the second PCB 452. As still another example, a first direction in which a beam formed by the first antenna array 440 faces, a second direction in which a beam formed by the second antenna array 455 faces, and a third direction in which a beam formed by the AE group 447 faces may be different. According to an embodiment, as still another example, the first PCB 451 and the second PCB 452 may be a rigid body, and the connection part 453 may be a flexible structure.

According to an embodiment, the communication circuit 430 and the first antenna array 440 may be positioned at the PCB 451. For example, the first antenna array 440 may be positioned on the first surface (e.g., a front surface) of the first PCB 451, and the communication circuit 430 may be positioned on a surface (e.g., a back surface) of the first PCB 451, which is opposite to the first surface. The first surface may be a surface facing the housing 210 of the electronic device 101. According to an embodiment, the second antenna array 445 may be positioned on a second surface (e.g., a front surface) of the second PCB 452. The second surface may be a surface facing the housing 210 of the electronic device 101. According to an embodiment, the AE group 447 may be positioned in the connection part 453 or on a third surface (e.g., a surface adjacent to a housing of the electronic device 101).

According to various embodiments, the communication circuit 430 may be electromagnetically connected with the first antenna array 440, the second antenna array 445, and/or the AE group 447.

According to an embodiment, the first antenna array 440 may include a plurality of first conductive plates (e.g., antenna elements). For example, the plurality of first conductive plates may form one antenna array. According to another embodiment, the second antenna array 445 may include a plurality of second conductive plates. For example, the plurality of second conductive plates may form one antenna array. According to another embodiment, the AE group 447 may include at least one or more third conductive plates. For example, each of the at least one or more third conductive plates may operate as a single antenna. As another example, each of the at least one or more third conductive plates may operate as at least one array antenna. As still another example, at least a part of the third conductive plates may operate as at least one array antenna, and the rest of the third conductive plates may operate as a single antenna.

According to an embodiment, each of the first antenna array 440, the second antenna array 445, and the AE group 447 may include at least one antenna element. The at least one antenna element may include at least one of a patch antenna, a shorted patch antenna, a slot antenna, a loop antenna, or a dipole antenna.

According to various embodiments, the communication circuit 430 may be configured to transmit/receive signals having a frequency between 3 GHz and 300 GHz. According to an embodiment, the communication circuit 430 may support a radio frequency signal in a band ranging from 24 GHz to 30 GHz and/or from 37 GHz to 40 GHz. According to an embodiment, the communication circuit 430 may up-convert or down-convert a frequency. For example, the communication circuit 430 included in the communication device 400 (e.g., the first communication device 321 of FIG. 3) may up-convert an IF signal received from a communication module (e.g., the communication module 350 of FIG. 3) (or a separate RFIC (not illustrated)) through a conductive line (e.g., the first conductive line 331 of FIG. 3). As another example, the communication circuit 430 may down-convert a millimeter wave signal received through the first antenna array 440 and/or the second antenna array 445, and may provide the down-converted signal to the communication module by using the conductive line.

In the following embodiments, the first PCB 451, the first antenna array 440, and the communication circuit 430 may be referred to as a "first planar structure". The second PCB 452 and the second antenna array 445 may be referred to as a "second planar structure". The connection part 453 and the AE group 447 may be referred to as a 'curved structure" or a "periphery".

Figure 5A:
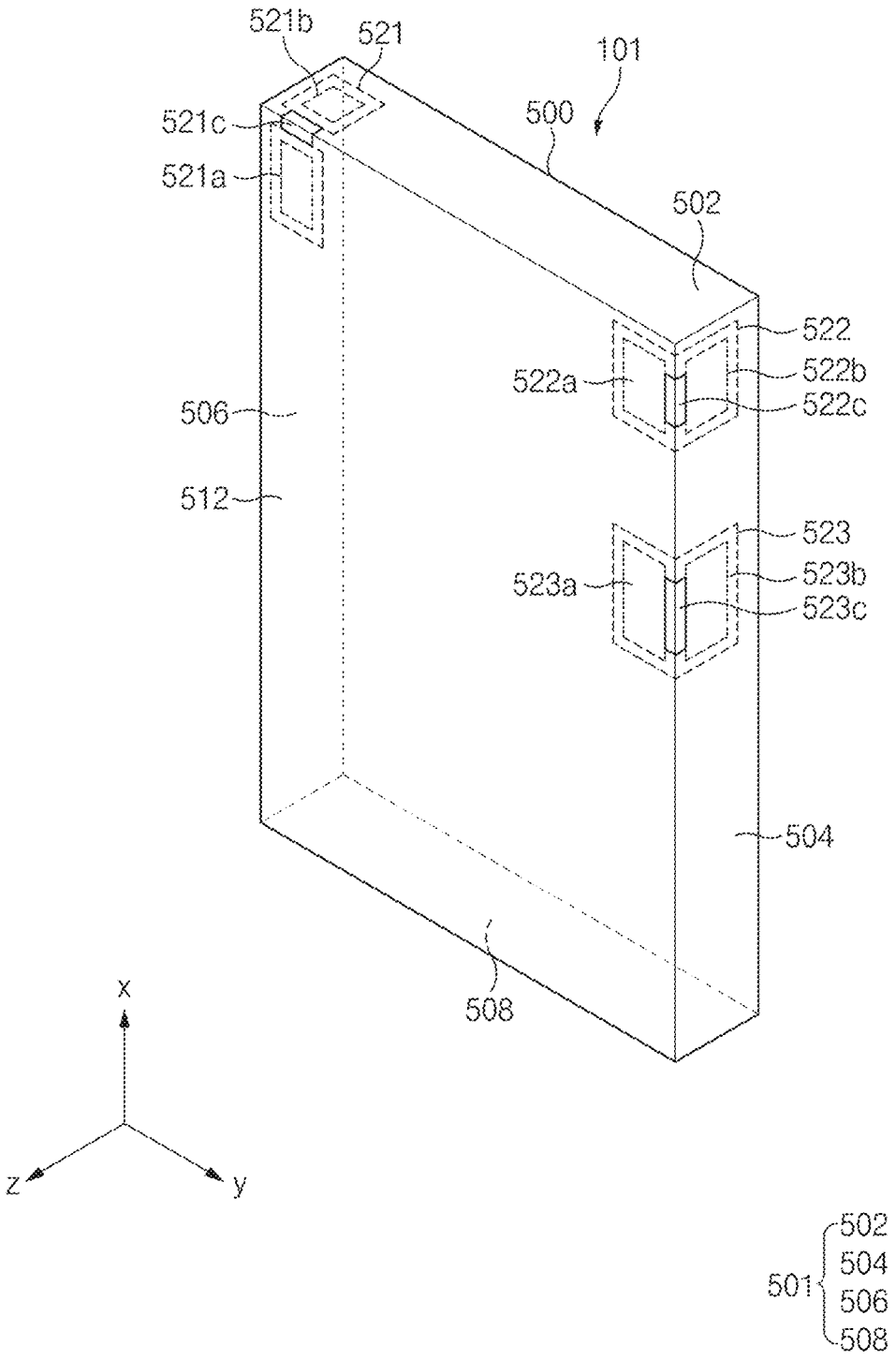
FIG. 5A illustrates one example of an electronic device including a plurality of communication devices according to an embodiment of the disclosure.

FIG. 5A illustrates one example of an electronic device including a plurality of communication devices according to an embodiment of the disclosure.

Referring to FIG. 5A, according to various embodiments, the electronic device 101 may include at least one of a first communication device 521, a second communication device 522, and a third communication device 523 that are mounted in a housing 500 (e.g., the housing 210 of FIG. 2) toward different directions. According to an embodiment, the first, second, and third communication devices 521, 522, and 523 may include first antenna arrays 521*a*, 522*a*, and 523*a* that are disposed substantially parallel to a back plate 512 (e.g., the back cover 212 of FIG. 2) of the electronic device 101. For example, each of the first antenna arrays 521*a*, 522*a*, and 523*a* may be referred to as the "first antenna array 440" of FIG. 4. According to an embodiment, the first, second, and third communication devices 521, 522, and 523 may also include second antenna arrays 521*b*, 522*b*, and 523*b* that are disposed substantially parallel to a side member 501 (e.g., the second side member 214 of FIG. 2) of the electronic device 101. For example, the side member 501 may include a first side member 502 that has a first length, a second side member 504 that is perpendicular to the first side member 502 and has a second length, a third side member 508 that is parallel to the first side member 502 and is perpendicular to the second side member 504, and has the first length, and/or a fourth side member 506 that is parallel to the second side member 504 and has the second length. For example, the second antenna arrays 521*b*, 522*b*, and 523*b* may be referred to as the "second antenna array 445" of FIG. 4. According to an embodiment, the first, second, and third communication devices 521, 522, and 523 may also include AE groups 521*c*, 522*c*, and 523*c* that are positioned adjacent to a periphery of the housing 500 of the electronic device 101. For example, the AE groups 521*c*, 522*c*, and 523*c* may be referred to as the "AE group 447" of FIG. 4. The first, second, and third communication devices 521, 522, and 523 may be implemented with an antenna structure or a non-planar structure.

For example, the first antenna array 521*a* of the first communication device 521 may be mounted to be adjacent to the first side member 502 and the fourth side member 506 and to face the back plate 512, when viewed from the back plate 512; the second antenna array 521*b* of the first communication device 521 may be mounted to face the first side member 502; and the AE group 521*c* of the first communication device 521 may be mounted to face a corner or a curved surface between the first side member 502 and the back plate 512. A mounting location of the first communication device 521 of FIG. 5A is not limited to the example of FIG. 5A. As another example, the first antenna array 521*a* of the first communication device 521 may be mounted to be adjacent to the first side member 502 and the fourth side member 506 and to face the back plate 512 when viewed from the back plate 512; the second antenna array 521*b* of the first communication device 521 may be mounted to face the first side member 502; and the AE group 521*c* of the first communication device 521 may be mounted to face the corner or the curved surface between the first side member 502 and the back plate 512.

For example, the first antenna array 522*a* of the second communication device 522 may be mounted to be adjacent to the first side member 502 and the second side member 504 and to face the back plate 512 when viewed from the back plate 512; the second antenna array 522*b* of the second communication device 522 may be mounted to face the second side member 504; and the AE group 522*c* of the second communication device 522 may be mounted to face a corner or a curved surface between the second side member 504 and the back plate 512. As another example, the first antenna array 522*a* of the second communication device 522 may be mounted to be adjacent to the first side member 502 and the second side member 504 and to face the back plate 512 when viewed from the back plate 512; the second antenna array 522*b* of the second communication device 522 may be mounted to face the second side member 504; and the AE group 522*c* of the second communication device 522 may be mounted to face the corner or the curved surface between the second side member 504 and the back plate 512.

For example, the first antenna array 523*a* of the third communication device 523 may be mounted to be further from the first side member 502 than the second communication device 522, to be adjacent to the second side member 504 and face the back plate 512, when viewed from the back plate 512; the second antenna array 523*b* of the third communication device 523 may be mounted to face the second side member 504; and the AE group 523*c* of the third communication device 523 may be mounted to face the corner or the curved surface between the second side member 504 and the back plate 512.

Figure 5B:
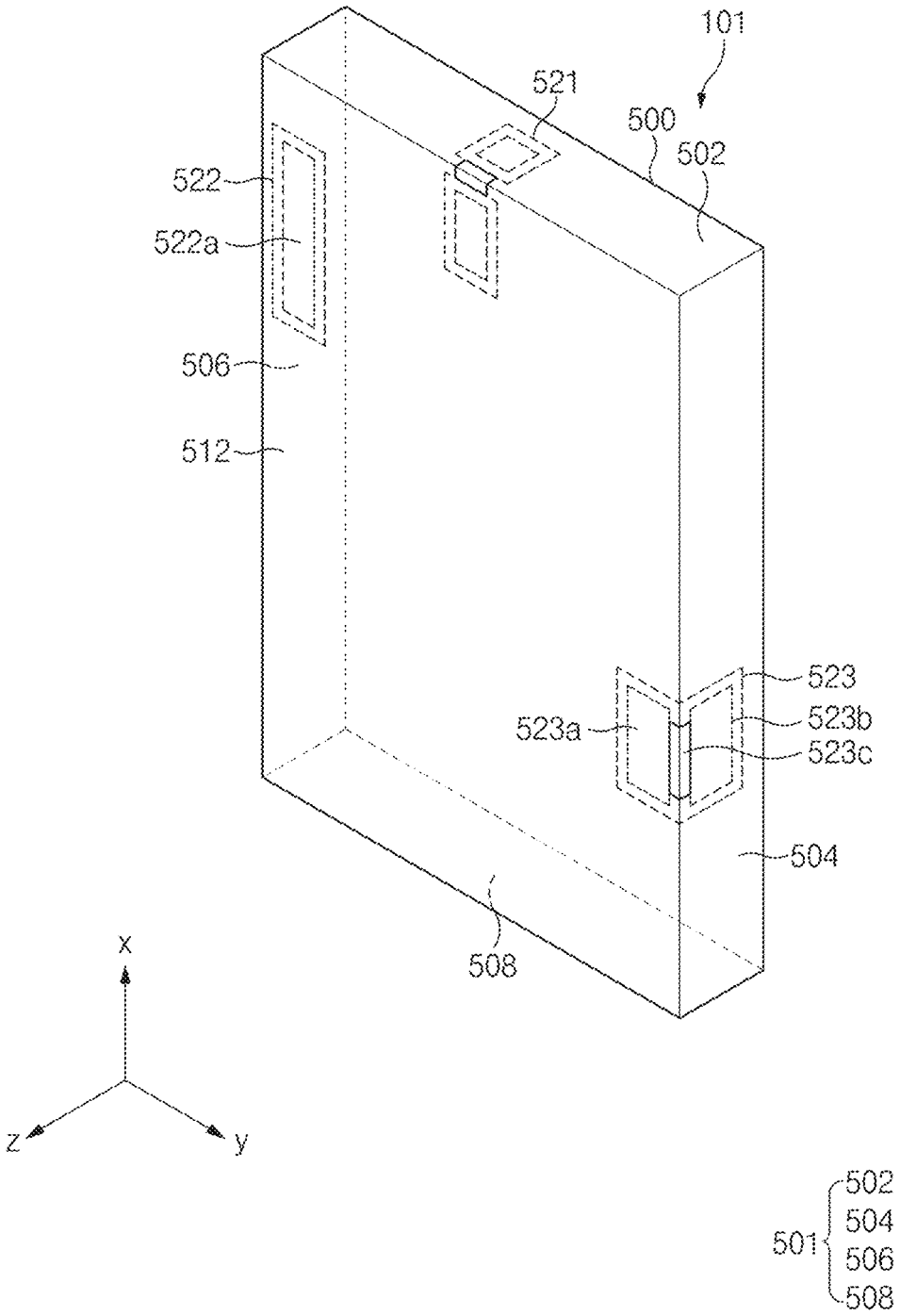
FIG. 5B illustrates another example of an electronic device including a plurality of communication devices according to an embodiment of the disclosure.

FIG. 5B illustrates another example of an electronic device including a plurality of communication devices according to an embodiment of the disclosure.

Referring to FIG. 5B, the first communication device 521 may be positioned on the substantial center of the first side member 502. As another example, the first antenna array 521*a* of the first communication device 521 may be mounted to be positioned on the center of the first side member 502 and to face the back plate 512 when viewed from the back plate 512; the second antenna array 521*b* of the first communication device 521 may be mounted to face the first side member 502; and the AE group 521*c* of the first communication device 521 may be mounted to face a corner or a curved surface between the first side member 502 and the back plate 512.

According to various embodiments, the first, second, and/or third communication devices 521, 522, and/or 523 may be implemented to face only one surface in the structure. According to an embodiment, the second communication device 522 may be mounted to be adjacent to the first side member 502 and the fourth side member 506 and to face the back plate 512. For example, the first antenna array 522*a* may be mounted to face the back plate 512.

According to various embodiments, the third communication device 523 may be mounted to be closer to the third side member 508 rather than the first side member 502. For example, the first antenna array 523*a* of the third communication device 523 may be mounted to face the back plate 512 when viewed from the back plate 512; the second antenna array 523*b* of the third communication device 523 may be mounted to face the second side member 504; and the AE group 523*c* of the third communication device 523 may be mounted to face a corner or a curved surface between the second side member 504 and the back plate 512.

The number, layout, and/or shapes of the first, second, and third communication devices 521, 522, and 523 illustrated in FIGS. 5A and 5B are only an example, and the number, layout, and/or shapes of the first, second, and third communication devices 521, 522, and 523 that are mounted on the electronic device 101 may be variously changed.

Figure 6A:
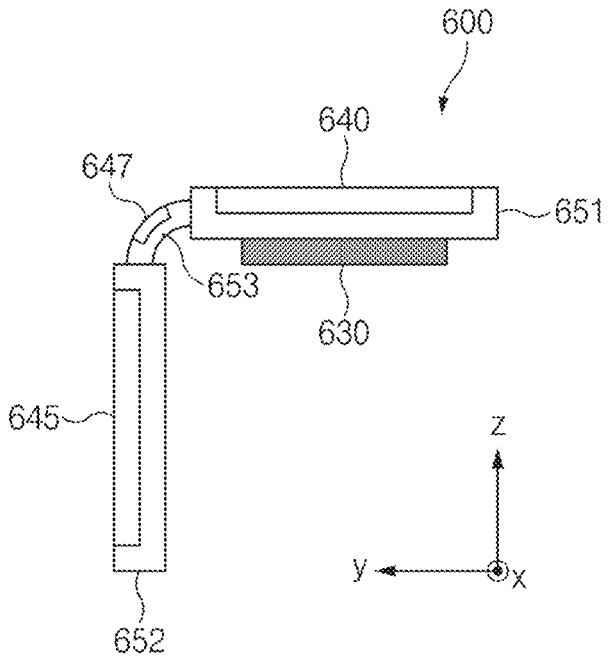
FIG. 6A illustrates an example of a communication device according to an embodiment of the disclosure.
Figure 6B:
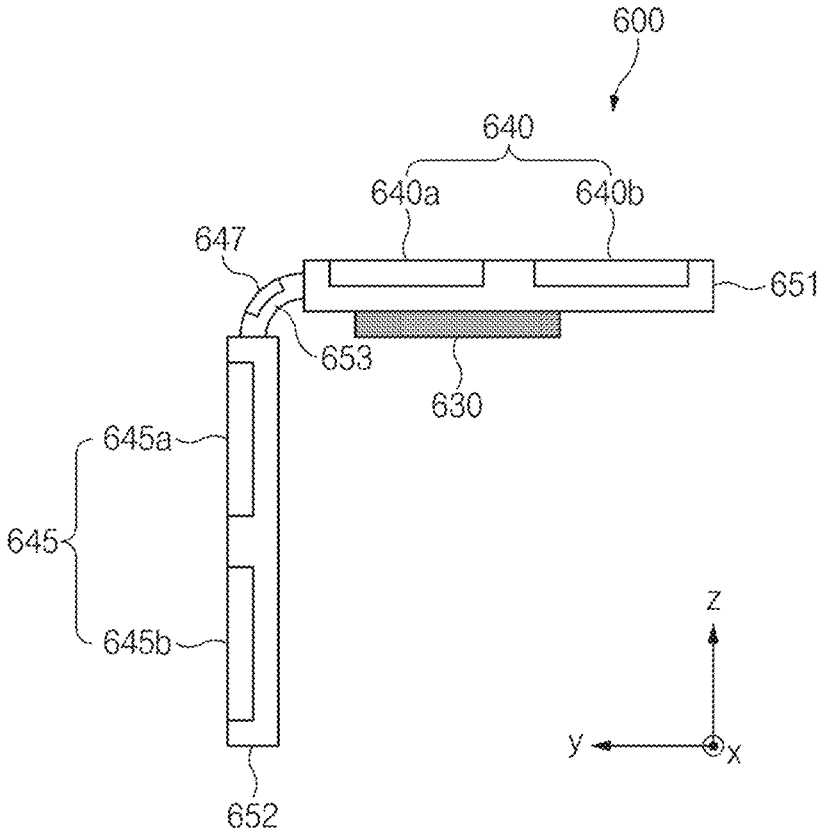
FIG. 6B illustrates another example of a communication device according to an embodiment of the disclosure.

Below, various examples of a communication device 600 will be described with reference to FIGS. 6A and 6B. In the following embodiments, the communication device 600 may refer to the "communication device 400" of FIG. 4. For example, the communication device 600 may be called an "antenna module", an "antenna structure", or an "RFA module". For example, a first antenna array 640 may refer to the "first antenna array 440" of FIG. 4, and a second antenna array 645 may refer to the "second antenna array 445" of FIG. 4. An AE group 647 may refer to the "AE group 447" of FIG. 4, and a first PCB 651, a second PCB 652, and a connection part 653 may refer to the "first PCB 451", the "second PCB 452", and the "connection part 453" of FIG. 4. A communication circuit 630 may correspond to the communication circuit 430 of FIG. 4. According to an embodiment, the communication circuit 630 may include a plurality of communication circuits. Below, for convenience of description, it is assumed that the communication device 600 of FIGS. 6A and 6B is mounted like the third communication device 523 of FIG. 5A. For example, the first antenna array 640, the second antenna array 645, and the AE group 647 may correspond to the first antenna array 523*a*, the second antenna array 523*b*, and the AE group 523*c* of the third communication device 523 of FIG. 5A, respectively.

FIG. 6A illustrates an example of a communication device according to an embodiment of the disclosure.

Referring to FIG. 6A, according to various embodiments, the communication device 600 may be implemented by using the first PCB 651, the second PCB 652, and the connection part 653. According to an embodiment, the first PCB 651 may include the first antenna array 640 that faces a first direction (e.g., a direction of a back surface) of an electronic device and is formed in the first PCB 651 or on the first PCB 651. The second PCB 652 may include the second antenna array 645 that faces a second direction (e.g., a direction of a side member) and is formed in the second PCB 652 or on the second PCB 652. The connection part 653 may include the AE group 647 that is extended from one end of the first PCB 651 to one end of the second PCB 652 and is formed therein or thereon. For example, the first antenna array 640 may be disposed on a first surface (e.g., a surface parallel to an x-y plane and exposed to the outside of the communication device 600 in a positive direction of the z axis) of the first PCB 651, and the second antenna array 645 may be disposed on a second surface (e.g., a surface parallel to an x-y plane and exposed to the outside of the communication device 600 in a positive direction of the y axis) of the second PCB 652. The AE group 647 may be disposed at the connection part 653 or on a third surface (e.g., a surface facing the housing 210 of FIG. 2). The communication circuit 630 may be disposed on a surface (e.g., a surface facing a negative direction of the z axis) facing away from a first surface of the first PCB 651.

According to an embodiment, the connection part 653 may be formed of a flexible material. For example, the connection part 653 may be a flexible PCB (FPCB). The connection part 653 may also include at least a feeding line and/or at least one ground line. According to an embodiment, the connection part 653 may be physically connected with at least one surface of the first PCB 651. According to an embodiment, the connection part 653 may also be physically connected with at least one surface of the second PCB 652. For example, the connection part 653 may physically connect the first PCB 651 and the second PCB 652. According to an embodiment, the connection part 653 may include at least one feeding line. For example, the connection part 653 may electromagnetically connect the first PCB 651 and the second PCB 652. The connection part 653 may also electromagnetically connect the communication circuit 630 and the second antenna array 645. According to an embodiment, the connection part 653 may be implemented in the shape of a curve having at least one curvature when mounted in the electronic device 101.

According to various embodiments, the communication circuit 630 may be configured to process, generate, and/or receive a first wireless signal and/or a second wireless signal. According to an embodiment, the communication circuit 630 may be electromagnetically coupled with the first antenna array 640 through a feeding line in the first PCB 651. The communication circuit 630 may be electromagnetically coupled with the second antenna array 645 through the connection part 653. For example, the communication circuit 630 may be electromagnetically coupled with the second antenna array 645 through the feeding line in the first PCB 651, the connection part 653, and/or a feeding line of the second PCB 652. The communication circuit 630 may be electromagnetically coupled with the AE group 647 through the connection part 653. For example, the AE group 647 may be a metal pattern formed at the connection part 653. According to an embodiment, the communication circuit 630 may be mounted on the first PCB 651 and may be electromagnetically connected with a communication module (e.g., the communication module 350 of FIG. 3) mounted on a separate PCB.

According to an embodiment, the communication device 600 may correspond to the third communication device 523 of FIG. 5A. Referring to FIGS. 5A and 6A, the first antenna array 523*a* of the third communication device 523 may be accommodated in the housing 500 and may be disposed in a direction (e.g., a positive direction of the z axis) facing the back plate 512 of the electronic device 101. For example, the first PCB 651 where the first antenna array 640 of the communication device 600 of FIGS. 6A and 6B is positioned may be disposed to face the positive direction of the z axis. The third communication device 523 may include the connection part 523*c* that is extended along the second side member 504. For example, when viewed from above a side member (e.g., the second side member 504 of FIG. 5A) of the communication device 600 of FIG. 6A, one end portion of the first PCB 651 may include the connection part 653 that is extended along one portion of the side member (e.g., the second side member 504 of FIG. 5A). For example, the connection part 653 may be bent along a shape of the second side member 504. The communication device 600 may include the second PCB 652 that faces the second side member 504. Also, the first PCB 651 and the second PCB 652 may be connected through the connection part 653. For example, the first PCB 651 and components (e.g., the communication circuit 630 and the first antenna array 640) included in (e.g., mounted on) the first PCB 651 may be called a "first planar structure". The second PCB 652 and components (e.g., the second antenna array 645) included in (e.g., mounted on) the second PCB 652 may be called a "second planar structure". The connection part 653 may be called a "periphery".

According to various embodiments, the communication circuit 630 may be configured to transmit and/or receive a signal having a frequency between 3 GHz and 300 GHz. According to various embodiments, the communication circuit 630 may also be configured to process, generate, and/or receive a first wireless signal having a center frequency of a first frequency band and/or a second wireless signal having a center frequency of a second frequency band. For example, the first frequency band may be a frequency band including a frequency of 28 GHz. The second frequency band may be a frequency band including a frequency of 39 GHz.

According to an embodiment, the first antenna array 640 may include a plurality of first conductive plates (e.g., antenna elements). For example, the plurality of first conductive plates may be formed in the first PCB 651 or on the first PCB 651. According to another embodiment, the second antenna array 645 may include a plurality of second conductive plates (e.g., antenna elements). For example, the plurality of second conductive plates may be formed in the second PCB 652 or on the second PCB 652. According to another embodiment, the AE group 647 may include a plurality of third conductive plates (e.g., antenna elements). For example, the plurality of third conductive plates may be formed in the connection part 653 or on the connection part 653. According to another embodiment, the AE group 647 may be a conductive pattern formed on one surface of the connection part 653.

According to various embodiments, the communication circuit 630 may transmit/receive a wireless signal by using at least one of the first antenna array 640, the second antenna array 645, and/or the AE group 647. According to various embodiments, the communication circuit 630 may transmit/receive a first signal having a first frequency by using at least one of the first antenna array 640, the second antenna array 645, and/or the AE group 647. According to various embodiments, the communication circuit 630 may transmit/receive a second signal having a second frequency different from the first frequency by using the second antenna array 645 and/or the AE group 647. For example, the communication circuit 630 may transmit/receive the first signal by using the first antenna array 640 and may transmit/receive the second signal by using the second antenna array 645 and/or the AE group 647.

In the following description, unless described otherwise, the description given with reference to FIG. 6A with regard to the operation and configuration of the communication device 600 may be identically applied to the communication device 600 of FIG. 6A. Thus, for convenience of description, additional descriptions will be omitted to avoid redundancy.

FIG. 6B illustrates another example of a communication device according to an embodiment of the disclosure.

Referring to FIG. 6B, the first antenna array 640 and the second antenna array 645 may include a plurality of sub antenna arrays, 640*a* and 640*b*, and 645*a* and 645*b*, respectively. According to an embodiment, the first antenna array 640 may include a plurality of first sub antenna arrays 640*a* and 640*b*. The second antenna array 645 may include a plurality of second sub antenna arrays 645*a* and 645*b*. For example, each of the first sub antenna arrays 640*a* and 640*b* may include at least one antenna element. Each of the second sub antenna arrays 645*a* and 645*b* may include at least one antenna element. The first sub antenna arrays 640*a* and 640*b* and the second sub antenna arrays 645*a* and 645*b* may include the same type or different types of antenna elements (e.g., a patch antenna, a dipole antenna, and/or a shorted patch antenna).

The configuration of sub antenna arrays illustrated in FIG. 6B is not limited thereto. For example, the first antenna array 640 may include a plurality of sub antenna arrays, and the second antenna array 645 may be implemented with one antenna array. As another example, the first antenna array 640 may be implemented with one antenna array, and the second antenna array 645 may include a plurality of sub antenna arrays. According to an embodiment, the first antenna array 640 may include "N" sub antenna arrays (N being an integer of 1 or more), and the second antenna array 645 may include "M" sub antenna arrays (M being an integer of 1 or more).

Figure 7:
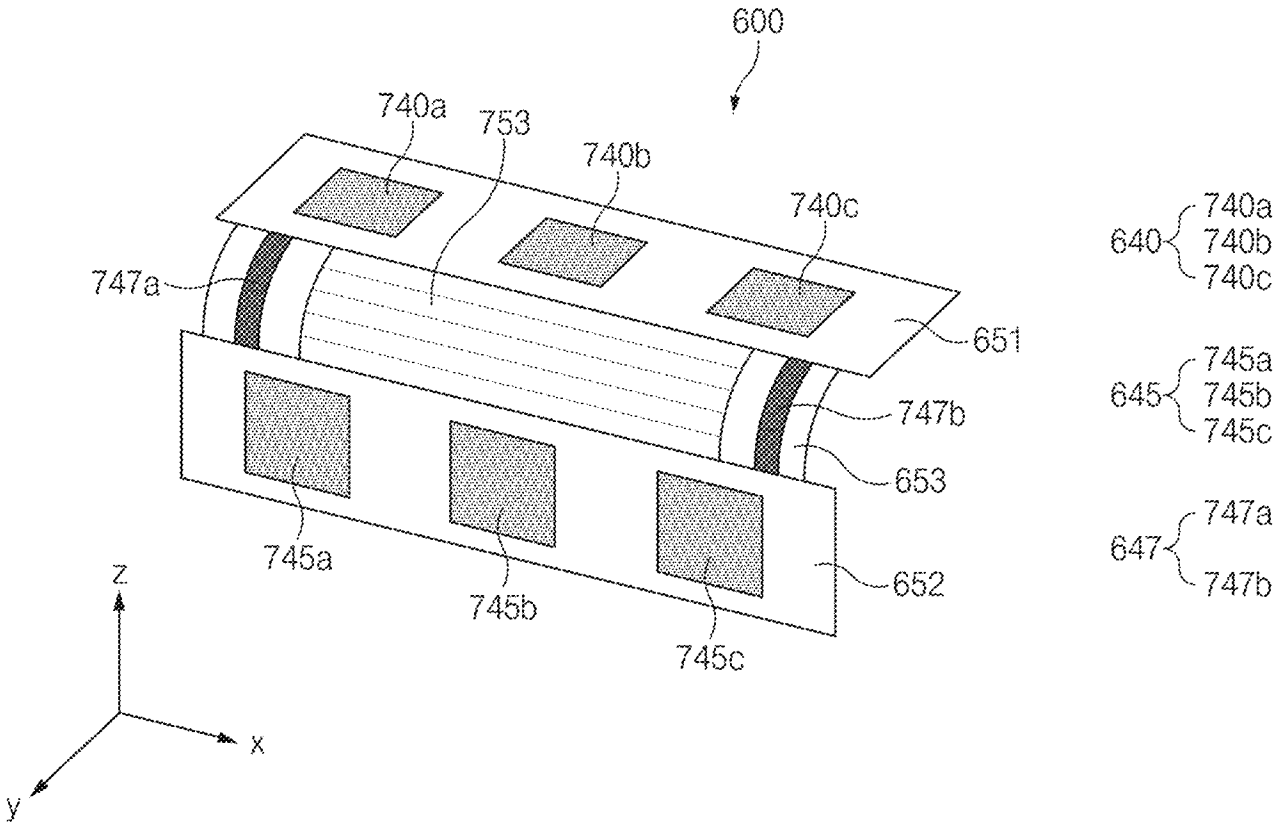
FIG. 7 illustrates a perspective view of a communication device according to an embodiment of the disclosure.

FIG. 7 illustrates a perspective view of a communication device according to an embodiment of the disclosure.

Referring to FIG. 7, for example, the communication device 600 may correspond to the communication device 600 illustrated in FIG. 6A. According to an embodiment, the communication device 600 may include the first PCB 651, the second PCB 652, and the connection part 653. The first antenna array 640 may be disposed on a first surface of the first PCB 651, and the first antenna array 640 may include at least one of a first antenna element 740*a*, a second antenna element 740*b*, and/or a third antenna element 740*c*. The second antenna array 645 may be disposed on a second surface of the second PCB 652, and the second antenna array 645 may include at least one of a fourth antenna element 745*a*, a fifth antenna element 745*b*, and/or a sixth antenna element 745*c*. According to an embodiment, a communication circuit (e.g., the communication circuit 630 of FIG. 6A) may be disposed on a surface (e.g., a surface facing a negative direction of the z axis) facing away from the first surface of the first PCB 651.

According to various embodiments, the AE group 647 may be disposed on one surface of the connection part 653. For example, the AE group 647 may include at least one of a seventh antenna element 747*a* and/or an eighth antenna element 747*b*. According to an embodiment, the connection part 653 may include a conductive region 753. A feeding line and/or a ground may be formed at the conductive region 753. The feeding line and/or the ground may be formed at the conductive region 753 or may be formed by a pattern inside the conductive region 753. For example, the conductive region 753 may be referred to as a "ground region". According to an embodiment, at least a portion of the conductive region 753 may be electrically connected with at least one of a ground region of the first PCB 651 or a ground region of the second PCB 652. For example, at least a portion of the conductive region 753 may be electrically connected with at least one of a ground layer in the first PCB 651 or a ground layer of the second PCB 652. According to an embodiment, at least one feeding line that is connected with at least one of the fourth antenna element 745*a*, the fifth antenna element 745*b*, and/or the sixth antenna element 745*c* of the second antenna array 645 may be positioned at the conductive region 753. According to an embodiment, the AE group 647 may be positioned in a fill cut region of the connection part 653. For example, the communication circuit 630 may be electromagnetically coupled with the AE group 647 through the conductive region 753. A feeding line that is connected from the conductive region 753 to the AE group 647 may be positioned on the fill cut region of the connection part 653 or in the fill cut region thereof. For example, the conductive region 753 may mean a region including a layer plated with metal (e.g., gold, silver, copper, nickel, and/or aluminum). The fill cut region may also mean a region where a metal plating layer is absent or a region where a metal plating layer is removed.

According to various embodiments, the antenna elements 747*a* and 747*b* of the AE group 647 may be a dipole antenna. For example, each of the seventh antenna element 747*a* and the eighth antenna element 747*b* may operate as a single antenna. According to an embodiment, a feeding line from the communication circuit 630 may be connected to each of the seventh antenna element 747*a* and the eighth antenna element 747*b*. According to an embodiment, a feeding line that is connected to the conductive region 753 from each of the seventh antenna element 747*a* and the eighth antenna element 747*b* may be positioned. For example, because the seventh antenna element 747*a* and the eighth antenna element 747*b* have a radiation pattern in a direction of a side surface (e.g., a positive x direction and/or a negative x direction), the coverage of the communication device 600 may be increased. Also, as the coverage is increased, the degree of freedom of location where the communication device 600 is positioned in the electronic device 101 may be increased. The configuration of the communication device 600 illustrated in FIG. 7 is not limited thereto.

Figure 14:
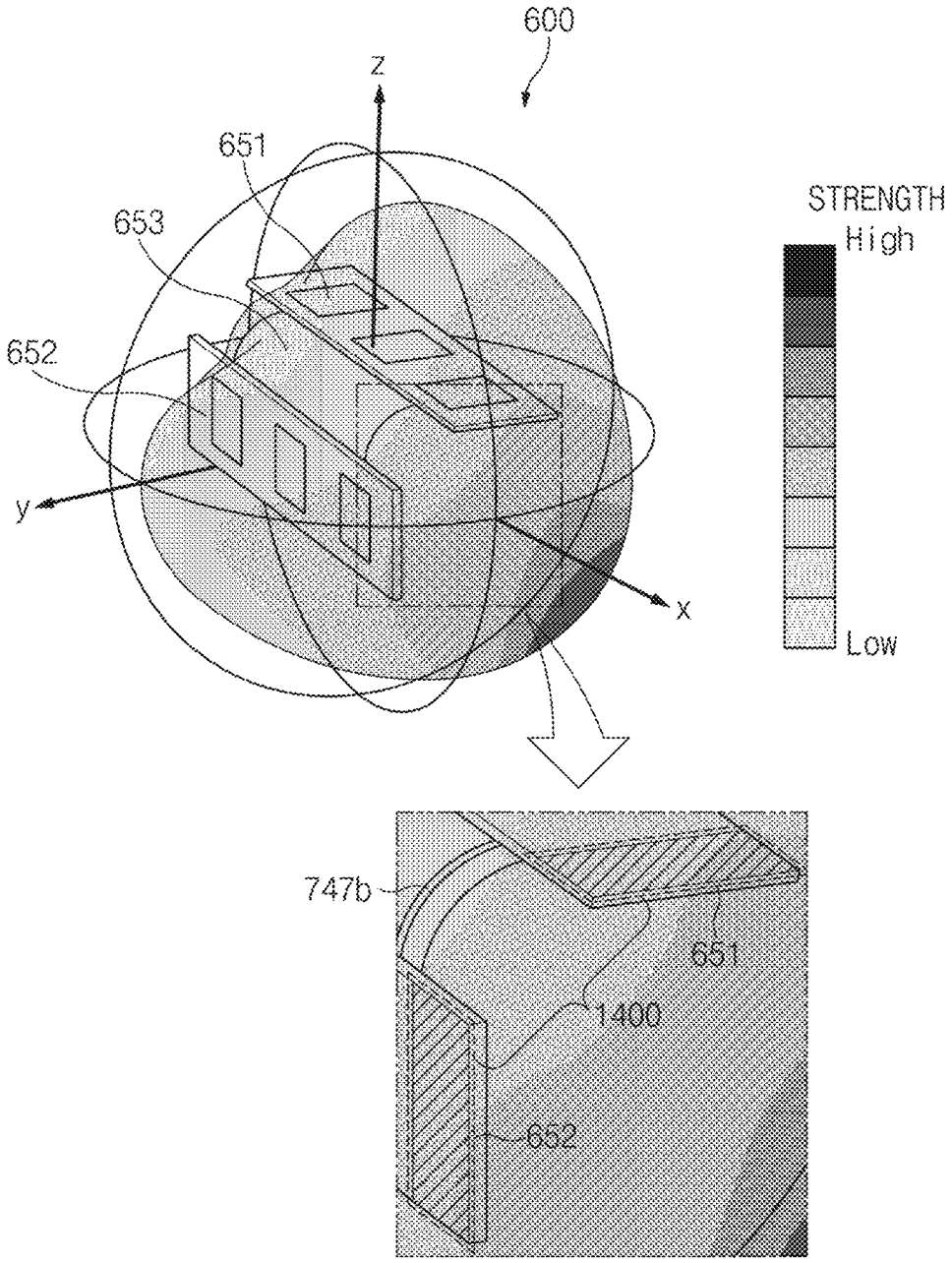
FIG. 14 illustrates radiation patterns of a communication device according to an embodiment of the disclosure.

According to various embodiments, the communication device 600 may control a radiation pattern of the seventh antenna element 747*a* and/or the eighth antenna element 747*b* by forming a ground region to be adjacent to the seventh antenna element 747*a* and/or the eighth antenna element 747*b*. FIG. 14 illustrates an example of a radiation pattern using the eighth antenna element 747*b* of the AE group 647 of the communication device 600 according to an embodiment of the disclosure.

FIG. 14 illustrates radiation patterns of a communication device according to an embodiment of the disclosure.

Figure 15:
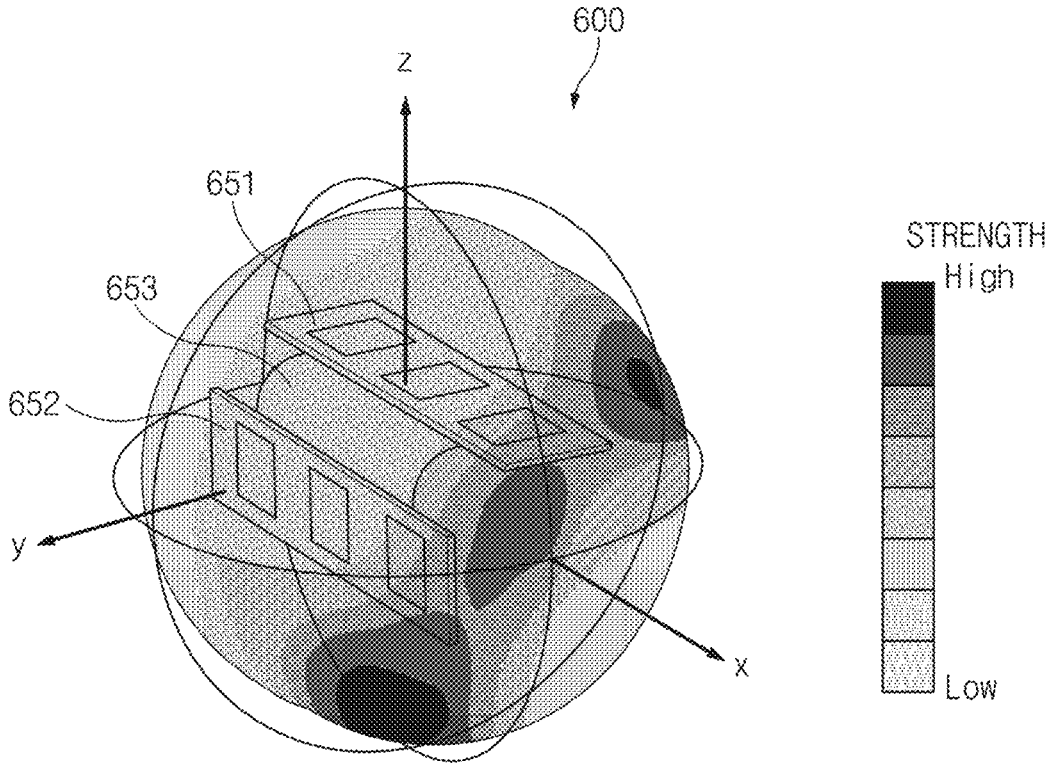
FIG. 15 illustrates radiation patterns of a communication device according to an embodiment of the disclosure.

Referring to FIG. 14, the first PCB 651 and the second PCB 652 may include a ground region 1400 to be adjacent to the eighth antenna element 747*b*. In FIG. 14, according to an embodiment, a radiation pattern of the eighth antenna element 747*b* may be oriented toward a side surface (e.g., in a positive direction of the x axis) of the communication device 600. For example, as the ground region 1400 plays a role of a lens or an aperture, the directivity of a radiation pattern of a beam generated by the eighth antenna element 747*b* may be increased. For example, in at least some directions, a gain of the beam generated from the eighth antenna element 747*b* may be increased. FIG. 15 illustrates an example of a radiation pattern using the eighth antenna element 747*b* of the AE group 647 of the communication device 600 according to an embodiment of the disclosure.

FIG. 15 illustrates radiation patterns of a communication device according to an embodiment of the disclosure.

Referring to FIG. 15, unlike the example of FIG. 14, in the example of FIG. 15, the first PCB 651 and the second PCB 652 may not include a ground region (e.g., the ground region 1400 of FIG. 14) at a region adjacent to the eighth antenna element 747*b* of FIG. 7. For example, a radiation pattern of FIG. 15 may be assumed as the ground region 1400 is removed from FIG. 14.

In FIG. 15, according to an embodiment, a radiation pattern of the eighth antenna element 747*b* may have a relatively omnidirectional characteristic compared with the radiation pattern FIG. 14. For example, a beam gain of a direction in which a first antenna array (e.g., the first antenna array 640 of FIG. 7) and/or a second antenna array (e.g., the second antenna array 645 of FIG. 7) faces may be increased by using the beam formed from the eighth antenna element 747*b*. The coverage of the communication device 600 may be expanded to a region not covered by the first antenna array 640 and the second antenna array 645 by using the beam formed from the eighth antenna element 747*b*.

With regard to FIGS. 14 and 15, the radiation pattern of the communication device 600 is described with reference to the eighth antenna element 747*b* of the communication device 600. The description given with reference to FIGS. 14 and 15 may be identically or similarly applied to the seventh antenna element 747*a* of FIG. 7.

Figure 8:
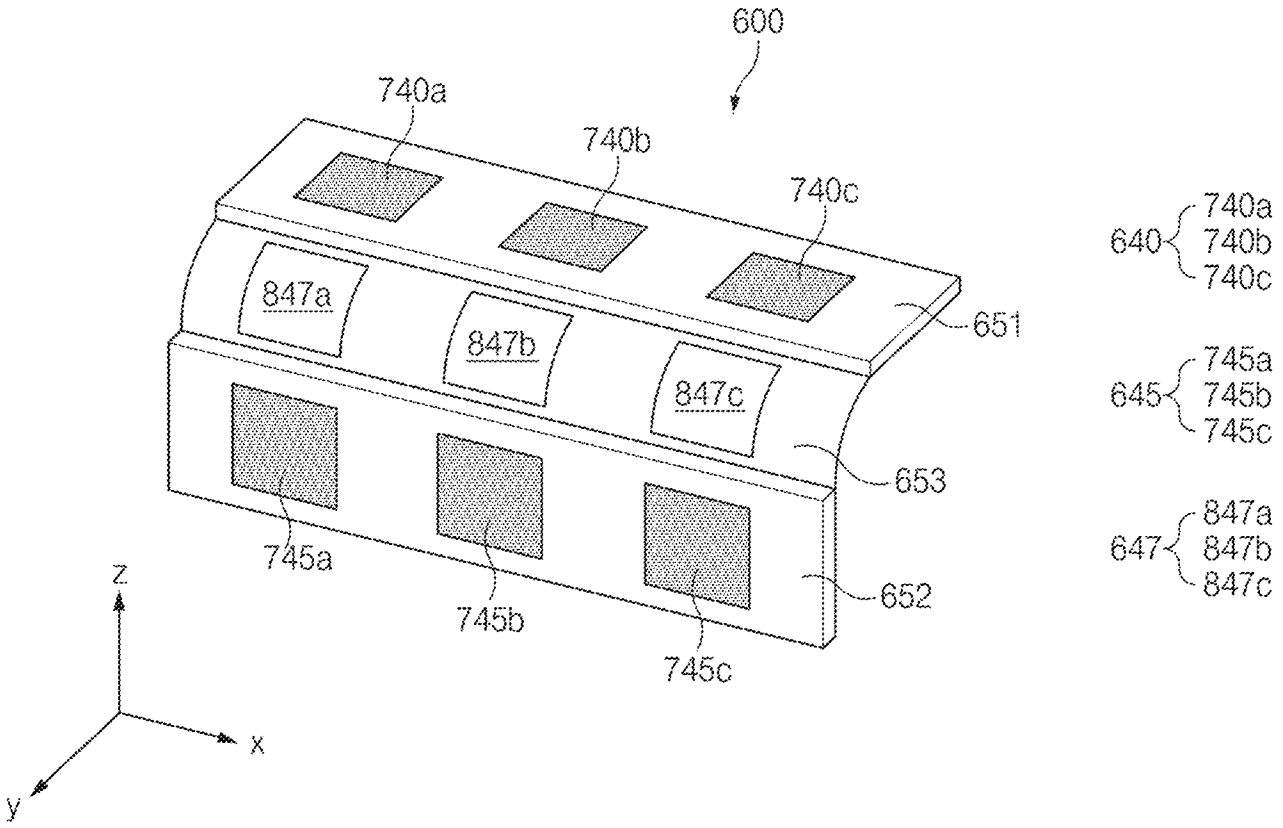
FIG. 8 illustrates a perspective view of a communication device according to an embodiment of the disclosure.

FIG. 8 illustrates a perspective view of a communication device according to an embodiment of the disclosure.

Referring to FIG. 8, a configuration of the communication device 600 of FIG. 8 may refer to the configuration of the communication device 600 of FIG. 7. With regard to the components having the same reference numeral, additional descriptions will be omitted to avoid redundancy.

According to various embodiments, the AE group 647 may include various shapes of antenna elements. According to an embodiment, the AE group 647 may include at least one of a seventh antenna element 847*a*, an eighth antenna element 847*b*, and/or a ninth antenna element 847*c*. According to an embodiment, the seventh antenna element 847*a*, the eighth antenna element 847*b*, and the ninth antenna element 847*c* may be an antenna element of a patch antenna shape. For example, the seventh antenna element 847*a*, the eighth antenna element 847*b*, and the ninth antenna element 847*c* may be a stacked patch or a dual-band patch using a dual-parasitic element. According to an embodiment, at least one of the seventh antenna element 847*a*, the eighth antenna element 847*b*, or the ninth antenna element 847*c* may operate as a single antenna. According to an embodiment, the seventh antenna element 847*a*, the eighth antenna element 847*b*, and the ninth antenna element 847*c* may operate as one antenna array.

According to various embodiments, a communication circuit (e.g., the communication circuit 630 of FIG. 6) may feed a signal to at least one of the seventh antenna element 847*a*, the eighth antenna element 847*b*, or the ninth antenna element 847*c* of the third AE group 647. According to an embodiment, the communication circuit 650 may directly feed a signal to at least one of the seventh antenna element 847*a*, the eighth antenna element 847*b*, or the ninth antenna element 847*c* of the AE group 647 through a via hole formed in the connection part 653. For example, the connection part 653 may include a transmission layer where a plurality of feeding lines are positioned. The communication circuit 630 may feed a signal through a via hole formed between the transmission layer and at least one of the seventh antenna element 847*a*, the eighth antenna element 847*b*, or the ninth antenna element 847*c*. According to an embodiment, the communication circuit 650 may also indirectly feed a signal into at least one of the seventh antenna element 847*a*, the eighth antenna element 847*b*, or the ninth antenna element 847*c* by using electromagnetic coupling. For example, the third communication circuit 630 may indirectly feed a signal into the seventh antenna element 847*a*, the eighth antenna element 847*b*, and/or the ninth antenna element 847*c* through a conductive region (e.g., a metal pattern) positioned in a layer (e.g., a transmission layer) below the seventh antenna element 847*a*, the eighth antenna element 847*b*, or the ninth antenna element 847*c*.

In the embodiment of FIG. 8, because directions that antenna elements of the first antenna array 640, the second antenna array 645, and/or the AE group 647 face are different from each other, the coverage of the communication device 600 may be increased. Because a plurality of patch-type antennas of the AE group 647 are used for beamforming as an array antenna, the beam coverage of the communication device 600 may be increased.

The configuration of the AE group 647 described with reference to FIGS. 7 and 8 are not limited thereto. For example, the AE group 647 may include a dipole antenna, a patch antenna, a shorted patch antenna, a slot antenna, an open-ended slot antenna, a folded dipole antenna, and/or a loop antenna.

Figure 9:
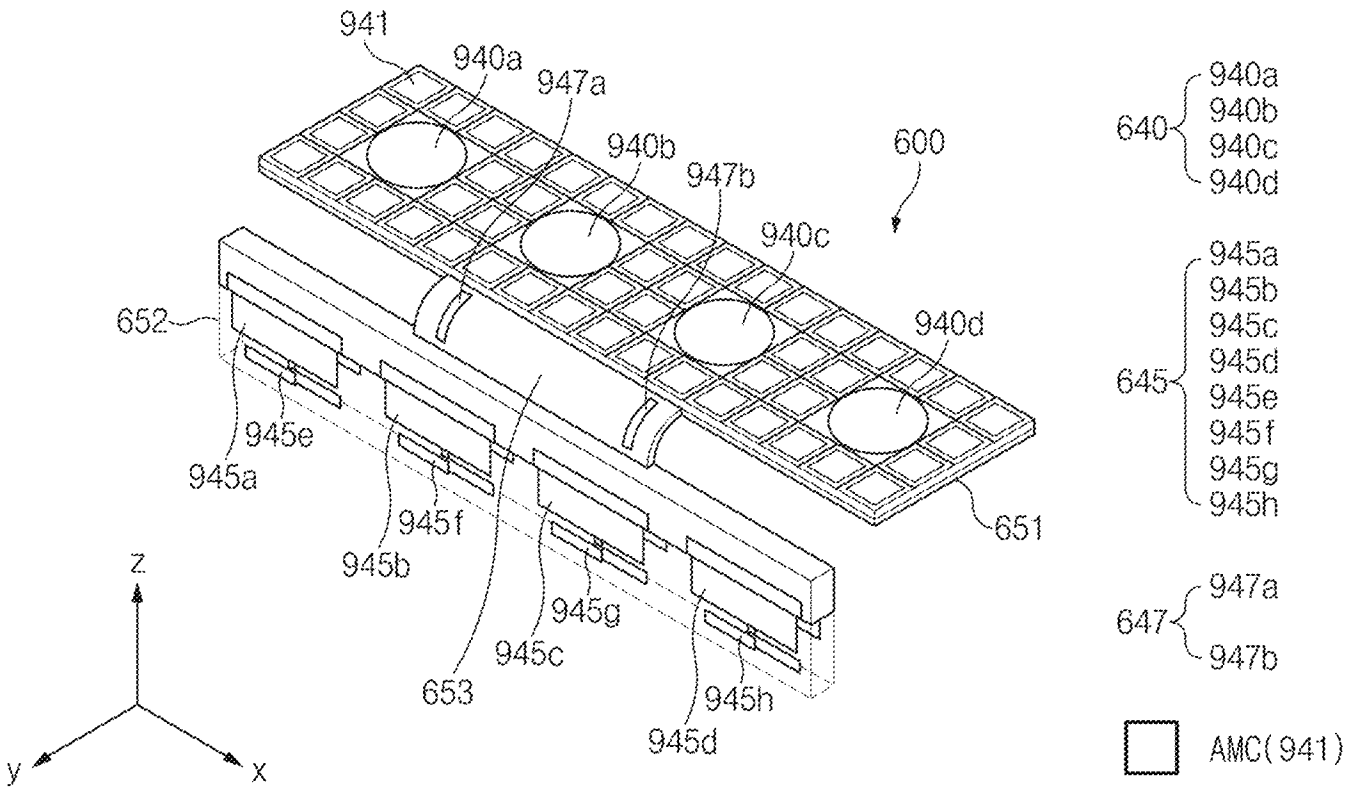
FIG. 9 illustrates a perspective view of a communication device according to an embodiment of the disclosure.

FIG. 9 illustrates a perspective view of a communication device according to an embodiment of the disclosure.

Referring to FIG. 9, the first antenna array 640 may include a plurality of antenna elements 940*a*, 940*b*, 940*c*, and 940*d*. For example, the plurality of antenna elements 940*a*, 940*b*, 940*c*, and 940*d* may include a patch antenna. According to an embodiment, the first antenna array 640 may be disposed on a first surface of the first PCB 651, and a plurality of artificial magnet conductor (AMC) elements 941 may also be arranged on the first surface. For example, the plurality of AMC elements 941 may be positioned between the plurality of antenna elements 940*a*, 940*b*, 940*c*, and 940*d*.

According to an embodiment, the second antenna array 645 may include a plurality of shorted patch antennas 945*a*, 945*b*, 945*c*, and 945*d* and a plurality of dipole antennas 945*e*, 945*f*, 945*g*, and 945*h*. According to an embodiment, the AE group 647 of the connection part 653 may include a plurality of dipole antennas 947*a* and 947*b*. For example, at least one of the plurality of dipole antennas 947*a* and 947*b* of the AE group 647 may operate as a single antenna.

Figure 10:
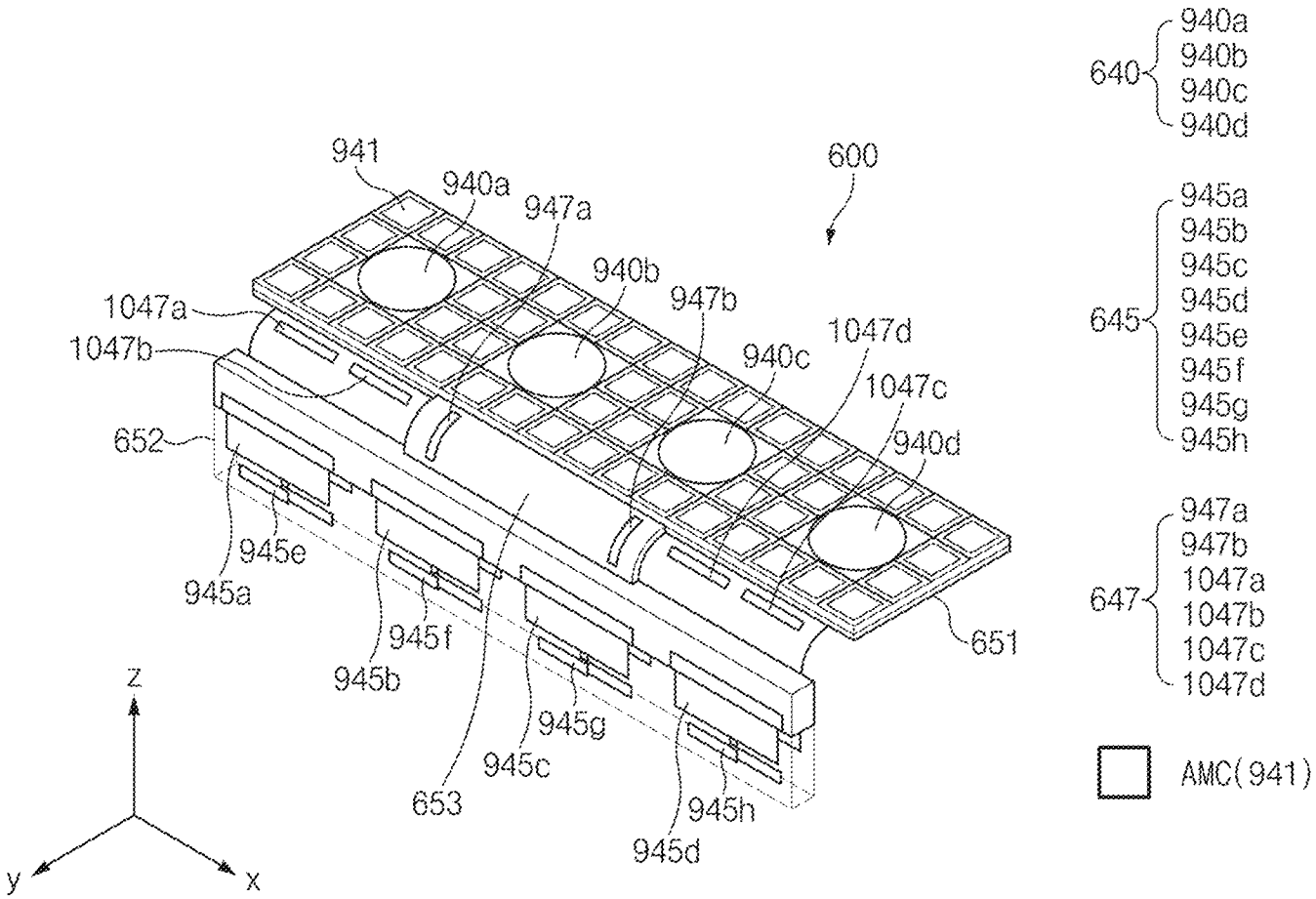
FIG. 10 illustrates a perspective view of a communication device according to an embodiment of the disclosure.

FIG. 10 illustrates a perspective view of a communication device according to an embodiment of the disclosure.

Referring to FIG. 10, in the communication device 600, a description associated with the same component may refer to the description associated with the communication device 600 of FIG. 9.

According to various embodiments, the connection part 653 may include a plurality of dipole antennas. According to an embodiment, the connection part 653 may include a plurality of dipole antennas configured to radiate wireless signals in different directions. For example, the AE group 647 of the connection part 653 may include the antenna elements 947*a* and 947*b* configured to radiate signals in a first direction and antenna elements 1047*a*, 1047*b*, 1047*c*, and 1047*d* configured to radiate signals in a second direction different from the first direction.

According to an embodiment, at least one of the antenna elements 947*a*, 947*b*, 1047*a*, 1047*b*, 1047*c*, and 1047*d* of the AE group 647 may operate as a single antenna. According to an embodiment, at least a part of the antenna elements 947*a*, 947*b*, 1047*a*, 1047*b*, 1047*c*, and 1047*d* of the AE group 647 may form one or more array antennas. For example, the antenna element 1047*a* and the antenna element 1047*b* may form one array antenna. For example, the antenna element 1047*c* and the antenna element 1047*d* may form one array antenna. For example, the antenna element 1047*a* and the antenna element 1047*b* may operate as one array antenna, the antenna element 1047*c* and the antenna element 1047*d* may operate as one array antenna, and each of the antenna element 947*a* and the antenna element 947*b* may operate as a single antenna.

Figure 11:
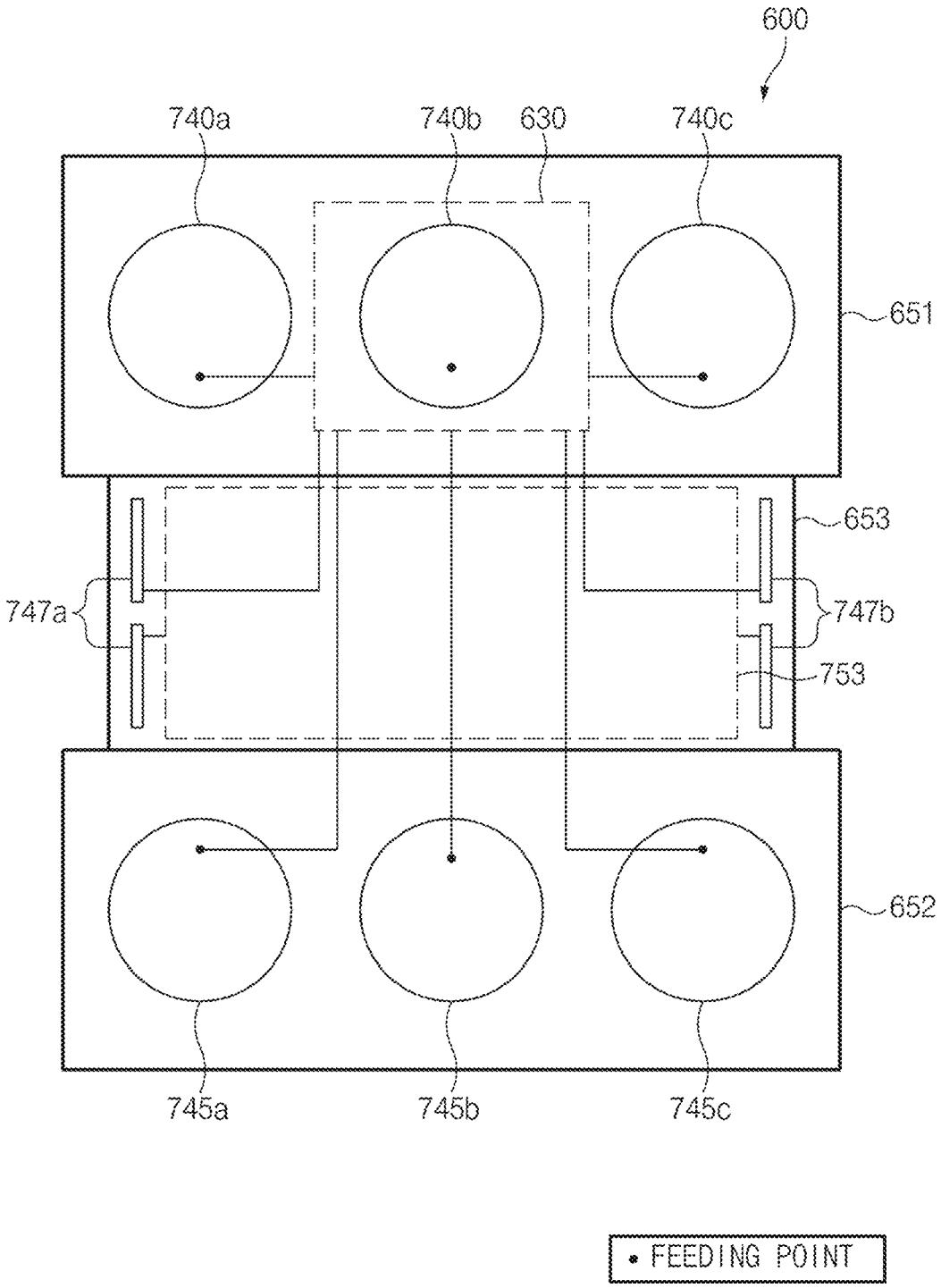
FIG. 11 is a connection diagram of a communication device according to an embodiment of the disclosure.

FIG. 11 is a connection diagram of a communication device according to an embodiment of the disclosure.

Referring to FIG. 11, it is assumed that the communication device 600 has the same configuration as the communication device 600 described with reference to FIG. 7. According to various embodiments, the communication circuit 630 may feed a signal to each antenna element through at least one feeding line. For example, a connection portion of each antenna element and each feeding line may be referred to as a "feeding point". According to an embodiment, in the case of a patch antenna, the communication circuit 630 may supply signals having different polarities to one patch antenna through two feeding lines. For example, two feeding lines may be coupled with a feeding point of each of the first antenna element 740*a*, the second antenna element 740*b*, the third antenna element 740*c*, the fourth antenna element 745*a*, the fifth antenna element 745*b*, and the sixth antenna element 745*c*. According to an embodiment, in the case of a dipole antenna, the communication circuit 630 may supply a signal to a dipole antenna through at least one feeding line. For example, one feeding line may be coupled with each of the seventh antenna element 747*a* and the eighth antenna element 747*b*. A dipole antenna is formed of two conductors (e.g., metal patterns). Thus, the remaining conductor that is not coupled with the feeding line may be connected to a ground positioned at the conductive region 753. For example, the conductive region 753 may be electrically and/or physically connected with at a ground layer of at least one of the first PCB 651 and the second PCB 652 and may be used as an antenna ground.

Figure 12:
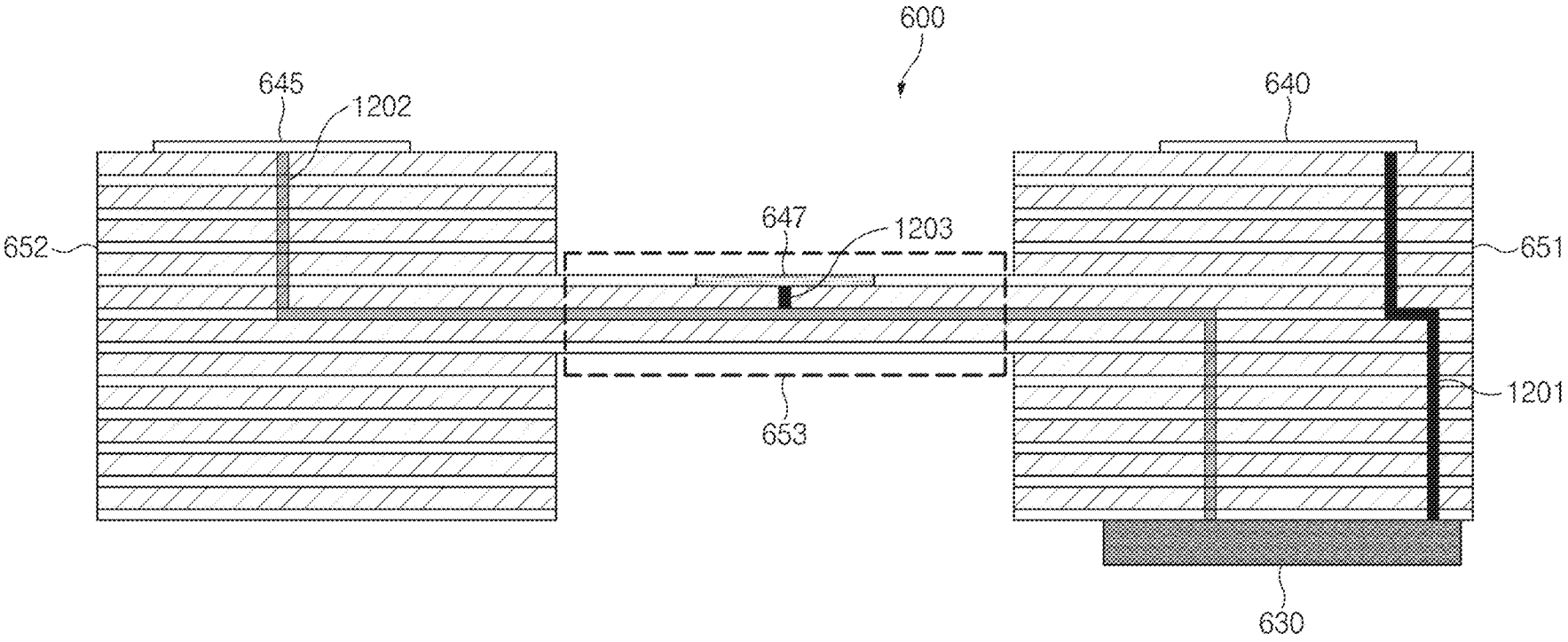
FIG. 12 illustrates a layer structure of a communication device according to an embodiment of the disclosure.

FIG. 12 illustrates a layer structure of a communication device according to an embodiment of the disclosure.

Referring to FIG. 12, the first PCB 651, the second PCB 652, and the connection part 653 may be implemented with a plurality of layers. For example, the first PCB 651, the second PCB 652, and the connection part 653 may include at least one conductive layer and at least one insulating layer. According to an embodiment, the connection part 653 may include fewer layers than the first PCB 651 and the second PCB 652 in number.

According to various embodiments, a signal path (e.g., a first feeding line 1201, a second feeding line 1202, and a third feeding line 1203) from the communication circuit 630 to at least one of the first antenna array 640, the second antenna array 645, or the AE group 647 may be formed in the plurality of layers. For example, the communication circuit 630 may supply a signal to the first antenna array 640 through the first feeding line 1201 formed in the first PCB 651. The communication circuit 630 may supply a signal to the second antenna array 645 through the second feeding line 1202 which is formed in one conductive layer positioned in the connection part 653. The communication circuit 630 may supply a signal to the AE group 647 through a via hole formed from the third feeding line 1203 of the connection part 653.

According to an embodiment, the first feeding line 1201, the second feeding line 1202, and the third feeding line 1203 may be formed to penetrate a plurality of layers. According to an embodiment, at least a portion of the first feeding line 1201 may be implemented to penetrate a plurality of layers of the first PCB 651. For example, the first feeding line 1201 may be formed through a via hole formed in the first PCB 651. According to an embodiment, at least a portion of the second feeding line 1202 may be implemented to penetrate a plurality of layers of the first PCB 651 and a plurality of layers of the second PCB 652. For example, at least a portion of the second feeding line 1202 may be formed through via holes formed in the first PCB 651 and the second PCB 652. The third feeding line 1203 may be implemented to penetrate a plurality of layers of the first PCB 651 and the connection part 653.

The second feeding line 1202 for the second antenna array 645 and the third feeding line 1203 for the AE group 647 are illustrated in FIG. 12 as being at least partially overlapping each other, but the second feeding line 1202 and the third feeding line 1203 do not overlap each other. For example, the second feeding line 1202 and the third feeding line 1203 may be disposed in the same layer so as to be spaced from each other. As another example, the second feeding line 1202 and the third feeding line 1203 may be disposed on different layers. A location of the connection part 653 and a layer where the connection part 653 is positioned is not limited to the example of FIG. 12.

Figure 13:
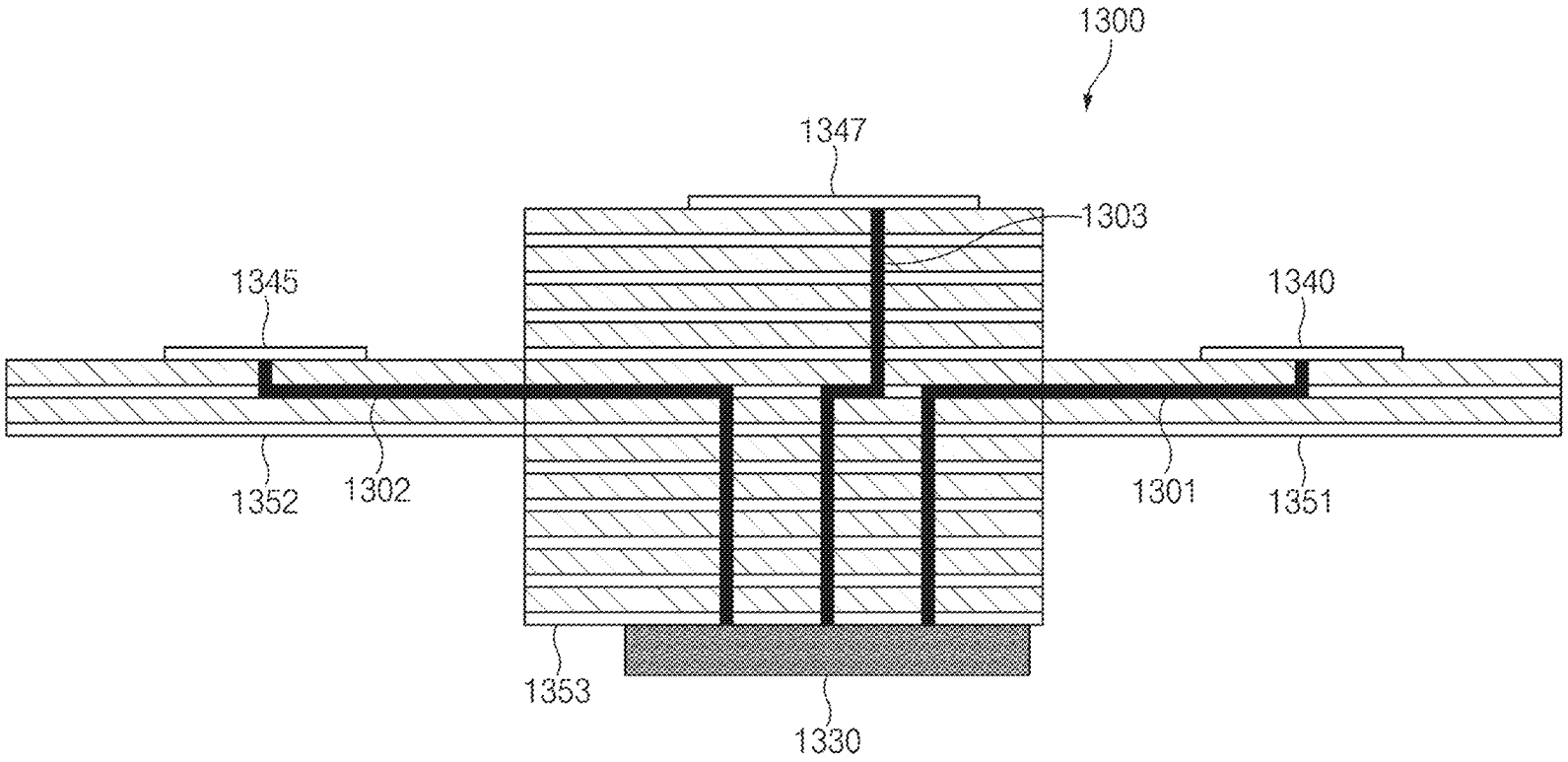
FIG. 13 illustrates a layer structure of a communication device according to an embodiment of the disclosure.

FIG. 13 illustrates a layer structure of a communication device according to an embodiment of the disclosure.

Referring to FIG. 13, unlike the communication device described with reference to FIGS. 4 to 12, a communication device may include FPCBs connected to opposite ends of a connection part, with the connection part interposed therebetween. In FIG. 13, according to an embodiment, a communication device 1300 may include a connection part 1353 formed of a rigid body. For example, the connection part 1353 may be a rigid PCB. According to an embodiment, a first PCB 1351 and a second PCB 1352 may be a FPCB. According to an embodiment, an AE group 1347 may be positioned on one surface (e.g., a front surface) of the connection part 1353, and a communication circuit 1330 may be positioned on an opposite surface thereof. A function of the communication circuit 1330 may be similar to the function of the communication circuit 430 of FIG. 4. For example, a first antenna array 1340, a second antenna array 1345, and the AE group 1347 may be electromagnetically connected with the communication circuit 1330 through a first feeding line 1301, a second feeding line 1302, and a third feeding line 1303, which are formed from the communication circuit 1330 positioned in the connection part 1353.

Figure 16:
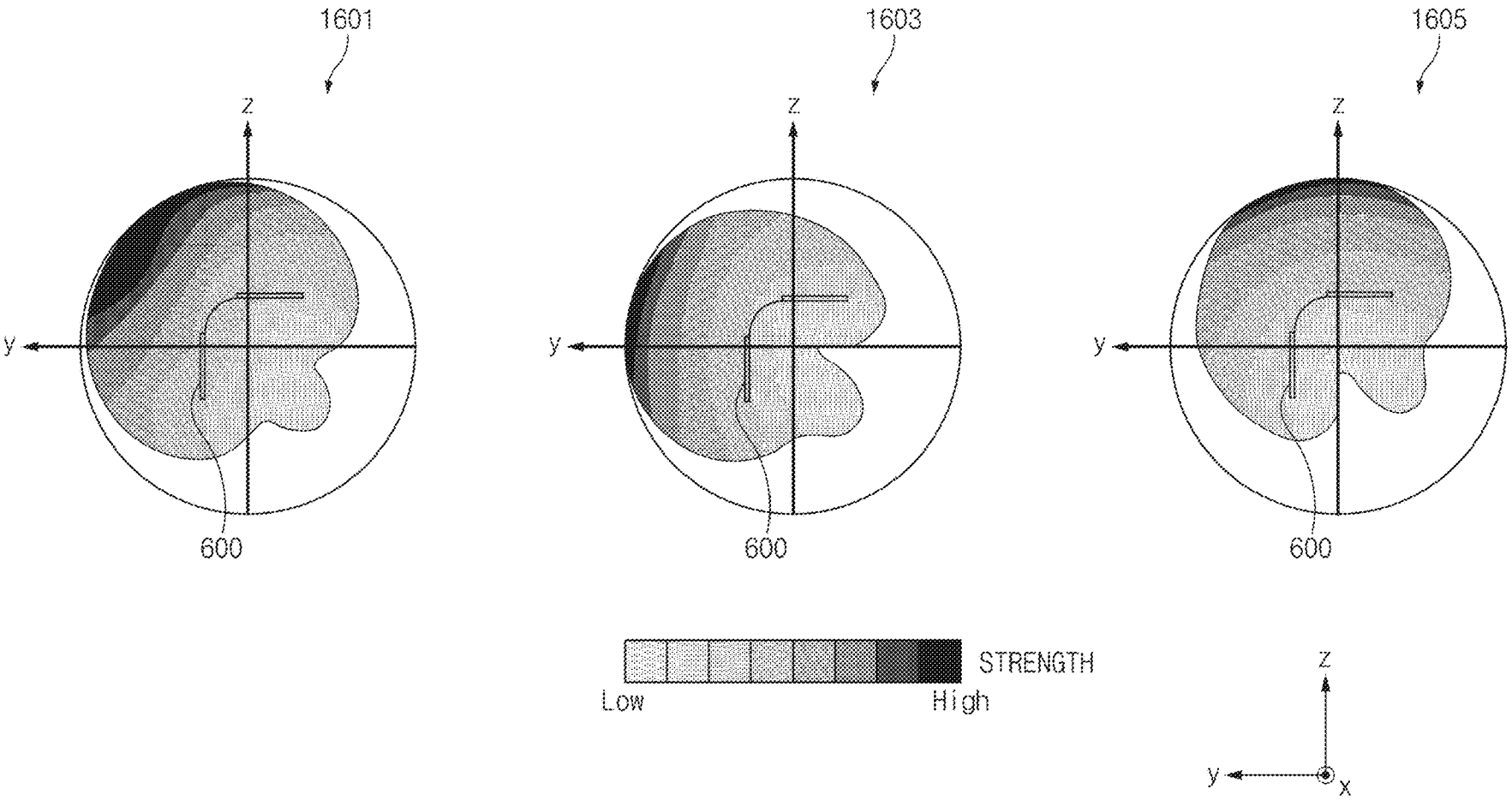
FIG. 16 illustrates radiation patterns of an antenna array according to an embodiment of the disclosure.
Figure 17:
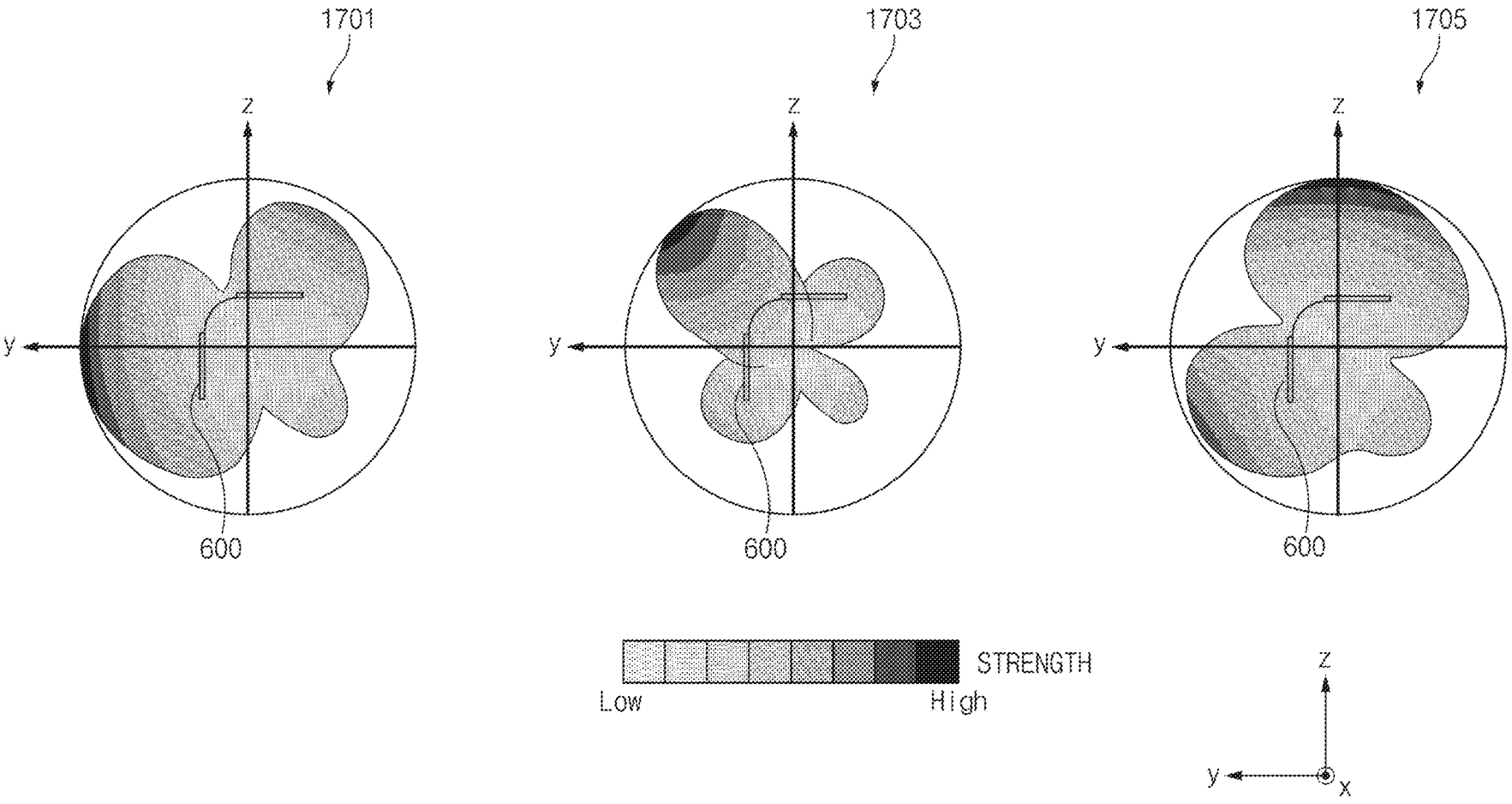
FIG. 17 illustrates combined radiation patterns of antenna arrays according to an embodiment of the disclosure.

In embodiments of FIGS. 16 and 17, it is assumed that the communication device 600 includes at least one patch-type antenna element in the connection part 653. For example, it is assumed that the communication device 600 of FIGS. 16 and 17 has substantially the same configuration as the communication device 600 of FIG. 8.

FIG. 16 illustrates radiation patterns of an antenna array according to an embodiment of the disclosure. A radiation pattern using each antenna array of the communication device 600 will now be described with reference to FIGS. 8 and 16.

Referring to FIG. 16, reference numeral 1601 indicates a radiation pattern of the first antenna array 640. Because patch antennas of the first antenna array 640 are arranged in a positive z direction, a radiation pattern of the first antenna array 640 may be focused around the positive z direction.

Reference numeral 1603 indicates a radiation pattern of the second antenna array 645. Because patch antennas of the second antenna array 645 are arranged in a positive x direction, a radiation pattern of the second antenna array 645 may be focused around the positive x direction.

Reference numeral 1605 indicates a radiation pattern of the AE group 647. Because the AE group 647 is disposed on a curved surface of the connection part 653, a radiation pattern of the AE group 647 may be focused on a direction between the positive z direction and the positive x direction.

FIG. 17 illustrates combined radiation patterns of antenna arrays according to an embodiment of the disclosure. A radiation pattern using a plurality of antenna arrays of the communication device 600 will now be described with reference to FIGS. 8 and 17.

Referring to FIG. 17, reference numeral 1701 indicates a combined radiation pattern of the first antenna array 640 and the AE group 647. Reference numeral 1703 indicates a combined radiation pattern of the first antenna array 640 and the second antenna array 645. Reference numeral 1705 indicates a combined radiation pattern of the second antenna array 645 and the AE group 647. As illustrated in FIG. 17, the directivity and coverage of the communication device 600 may be increased through a combined radiation of antenna arrays.

According to various embodiments, an electronic device (e.g., the electronic device 101 of FIG. 2) may include a housing (e.g., the housing 210 of FIG. 2) that includes a first plate (e.g., the cover glass 212 of FIG. 2) and a second plate (e.g., the back cover 212 of FIG. 2) facing away from the first plate, a display (e.g., the display 220 of FIG. 2) that is viewable through a portion of the first plate and is positioned in the housing, and an antenna structure (e.g., the communication device 600 of FIG. 6A) that is positioned in the housing. According to an embodiment, the antenna structure may include a first printed circuit board (PCB) (e.g., the first PCB 651 of FIG. 6A) that includes a first surface facing a first direction, a second PCB (e.g., the second PCB 652 of FIG. 6A) that includes a second surface facing a second direction different from the first direction, a flexible PCB (FPCB) (e.g., the connection part 653 of FIG. 6A) that is extended between a first periphery of the first PCB and a second periphery of the second PCB, at least one first conductive pattern (e.g., the first antenna array 640 of FIG. 6A) that is formed in the first PCB or on the first surface, at least one second conductive pattern (e.g., the second antenna array 645 of FIG. 6A) that is formed in the second PCB or on the second surface, at least one wireless communication circuit (e.g., the communication circuit 630 of FIG. 6A) that is mounted on the first PCB and/or the second PCB and transmits and/or sends a signal having a frequency between 3 GHz and 100 GHz, at least one conductive line that electrically connects the at least one wireless communication circuit and one of the first conductive pattern or the second conductive pattern and is disposed in the FPCB, and at least one third conductive pattern (e.g., the AE group 647 of FIG. 6A) that is positioned in the FPCB and is electrically connected with the at least one wireless communication circuit.

According to an embodiment, the first surface may face the second plate (e.g., the back cover 212 of FIG. 2).

According to an embodiment, the first direction may be substantially perpendicular to the second direction.

According to an embodiment, the at least one third conductive pattern (e.g., the AE group 647 of FIG. 6A) may be a metal pattern formed on the FPCB (e.g., the connection part 653 of FIG. 6A).

According to an embodiment, the at least one third conductive pattern (e.g., the AE group 647 of FIG. 6A) may be formed in a fill cut region of the FPCB (e.g., the connection part 653 of FIG. 6A).

According to an embodiment, the first PCB (e.g., the first PCB 651 of FIG. 6A) and the second PCB (e.g., the second PCB 652 of FIG. 6A) may include a plurality of layers, and the FPCB (e.g., the connection part 653 of FIG. 6A) may include layers corresponding to at least a part of the plurality of layers.

According to an embodiment, the electronic device may further include a third PCB (e.g., the PCB 230 of FIG. 2) that is interposed between the display (e.g., the display 220 of FIG. 2) and the second plate (e.g., the back cover 212 of FIG. 2) and is parallel to the first PCB (e.g., the first PCB 651 of FIG. 6A), and a communication circuit (e.g., the communication module 350 of FIG. 3) that is mounted on the third PCB and is electrically connected with the at least one wireless communication circuit (e.g., the communication circuit 630 of FIG. 6A).

According to an embodiment, the at least one first conductive pattern (e.g., the first antenna array 640 of FIG. 6A) and the at least one second conductive pattern (e.g., the second antenna array 645 of FIG. 6A) may include at least one patch antenna element, and the at least one third conductive pattern (e.g., the third antenna element group 647) may include at least one dipole antenna.

According to various embodiments, an electronic device (e.g., the electronic device 101 of FIG. 2) may include a housing (e.g., the housing 210 of FIG. 2) that includes a first plate (e.g., the cover glass 211 of FIG. 2), a second plate (e.g., the back cover 212 of FIG. 2) facing away from the first plate, and a side member (e.g., the first side surface (210*a*, 210*b*, 210*c*, 210*d*) and the second side surface 214 of FIG. 2) surrounding a space between the first plate and the second plate, a display (e.g., the display 220 of FIG. 2) that is visually exposed through a portion of the first plate and is positioned in the housing, and an antenna structure (e.g., the communication device 600 of FIG. 6A) that is positioned in the housing. According to an embodiment, the antenna structure may include a first planar structure (e.g., the first PCB 651 of FIG. 6A) that faces the second plate, a connection part (e.g., the connection part 653 of FIG. 6A), a first end of which is bent and extended toward the side member from one end of the first planar structure, a second planar structure (e.g., the second PCB 652 of FIG. 6A) that faces the side member and is connected with a second end of the connection part, which is opposite to the first end, and at least one wireless communication circuit (e.g., the communication circuit 630 of FIG. 6A). According to an embodiment, the first planar structure may include a plurality of first conductive plates (e.g., the first antenna array 640 of FIG. 6A) formed therein or thereon, the connection part may include at least one third conductive plate (e.g., the third antenna element group 647 of FIG. 6A) formed therein or thereon, and the second planar structure may include a plurality of second conductive plates (e.g., the second antenna array 645 of FIG. 6A) formed therein or thereon. The at least one wireless communication circuit may be electromagnetically connected with the plurality of first conductive plates, the plurality of second conductive plates, and the at least one third conductive plate and may transmit or receive a signal having a frequency between 3 GHz and 100 GHz.

According to an embodiment, the connection part (e.g., the connection part 653 of FIG. 6A) may be different from the first planar structure (e.g., the first PCB 651 of FIG. 6A) and the second planar structure (e.g., the second PCB 652 of FIG. 6A) in at least one of a thickness, a number of layers, a flexibility, or a curvature.

According to an embodiment, the first planar structure (e.g., the first PCB 651 of FIG. 6A) may include a first printed circuit board (PCB), the second planar structure (e.g., the second PCB 652 of FIG. 6A) may include a second PCB, and the connection part (e.g., the connection part 653 of FIG. 6A) may include a flexible PCB (FPCB).

According to an embodiment, the at least one third conductive plate (e.g., the third antenna element group 647 of FIG. 6A) may be a metal pattern formed on the connection part (e.g., the connection part 653 of FIG. 6A).

According to an embodiment, the at least one third conductive plate (e.g., the third antenna element group 647 of FIG. 6A) is positioned in a fill cut region of the connection part (e.g., the connection part 653 of FIG. 6A).

According to an embodiment, the first planar structure (e.g., the first PCB 651 of FIG. 6A) and the second planar structure (e.g., the second PCB 652 of FIG. 6A) may include a plurality of layers, and the connection part (e.g., the connection part 653 of FIG. 6A) may include layers corresponding to at least a part of the plurality of layers.

According to an embodiment, the at least one third conductive plate (e.g., the third antenna element group 647 of FIG. 6A) may be electrically connected with at least one feeding line through a via hole.

According to various embodiments, an electronic device (e.g., the electronic device 101 of FIG. 2) may include a housing (e.g., the housing 210 of FIG. 2) that forms an exterior of the electronic device and includes a front surface, a back surface facing away from the front surface, and a side surface surrounding at least a portion of a space between the front surface and the back surface, and a communication device (e.g., the communication device 600 of FIG. 6A) that includes a first antenna array (e.g., the first antenna array 640 of FIG. 6A) disposed to face the back surface, a second antenna array (e.g., the second antenna array 645 of FIG. 6A) disposed to face the side surface, and a third antenna element group (e.g., the third antenna element group 647 of FIG. 6A) that is interposed between the first antenna array and the second antenna array and is formed in a shape of a curve having at least one curvature. According to an embodiment, the first antenna array may include a plurality of first antenna elements, the second antenna array may include a plurality of second antenna elements, and the third antenna element group (e.g., the third antenna element group 647 of FIG. 6A) may include at least one third antenna element.

According to an embodiment, the first antenna array (e.g., the first antenna array 640 of FIG. 6A) may be formed on a first printed circuit board (PCB) (e.g., the first PCB 651 of FIG. 6A) or in the first PCB, the second antenna array (e.g., the second antenna array 645 of FIG. 6A) may be formed on a second PCB (e.g., the second PCB 652 of FIG. 6A) or in the second PCB, and the third antenna element group (e.g., the third antenna element group 647 of FIG. 6A) may be formed on a flexible PCB (FPCB) (e.g., the connection part 653 of FIG. 6A) or in the FPCB.

According to an embodiment, the FPCB (e.g., the connection part 653 of FIG. 6A) may be different from the first PCB (e.g., the first PCB 651 of FIG. 6A) and the second PCB (e.g., the second PCB 652 of FIG. 6A) in at least one of a thickness, a number of layers, a flexibility, or a curvature.

According to an embodiment, the at least one third antenna element (e.g., the third antenna element group 647 of FIG. 6A) may be a metal pattern formed in a fill cut region of the FPCB (e.g., the connection part 653 of FIG. 6A).

According to an embodiment, the first antenna array (e.g., the first antenna array 640 of FIG. 6A) may be configured to radiate a signal in a first direction, the second antenna array (e.g., the second antenna array 645 of FIG. 6A) may be configured to radiate a signal in a second direction substantially perpendicular to first direction, and the third antenna element group (e.g., the third antenna element group 647 of FIG. 6A) may be configured to radiate a signal in a direction different from the first direction and the second direction.

The electronic device according to various embodiments may be one of various types of electronic devices. The electronic devices may include, for example, a portable communication device (e.g., a smart phone), a computer device, a portable multimedia device, a portable medical device, a camera, a wearable device, or a home appliance, but are not limited thereto.

It should be appreciated that various embodiments of the disclosure and the terms used therein are not intended to limit the technological features set forth herein to particular embodiments, and include various changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of phrases such as "A or B," "at least one of A and B," "at least one of A or B," "A, B, or C," "at least one of A, B, and C," and "at least one of A, B, or C," may include all possible combinations of the items enumerated together in a corresponding one of the phrases. As used herein, such terms as "1st" and "2nd," or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., wiredly), wirelessly, or via a third element.

As used herein, the term "module" may include a unit implemented in hardware, software, firmware, or combinations thereof, and may interchangeably be used with other terms, for example, "logic," "logic block," "part," or "circuitry". A module may be a single integral component, or a minimum unit or part thereof, adapted to perform one or more functions. For example, according to an embodiment, the module may be implemented in a form of an application-specific integrated circuit (ASIC).

Various embodiments as set forth herein may be implemented as software (e.g., the program 140) including one or more instructions that are stored in a storage medium (e.g., internal memory 136 or external memory 138) that is readable by a machine (e.g., the electronic device 101). For example, a processor (e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a complier or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to an embodiment, a method according to various embodiments of the disclosure may be included and provided in a computer program product. The computer program product may be traded as a product between a seller and a buyer. The computer program product may also be distributed in the form of a machine-readable storage medium (e.g., compact disc read only memory (CD-ROM)), or be distributed (e.g., downloaded or uploaded) online via an application store (e.g., Play Store™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to various embodiments, each component (e.g., a module or a program) of the above-described components may include a single entity or multiple entities. According to various embodiments, one or more of the above-described components may be omitted, or one or more other components may be added. Alternatively or additionally, a plurality of components (e.g., modules or programs) may be integrated into a single component. In such a case, according to various embodiments, the integrated component may still perform one or more functions of each of the plurality of components in the same or similar manner as they are performed by a corresponding one of the plurality of components before the integration. According to various embodiments, operations performed by the module, the program, or another component may be carried out sequentially, in parallel, repeatedly, or heuristically, or one or more of the operations may be executed in a different order or omitted, or one or more other operations may be added.

According to various embodiments of the disclosure, an available space in a housing of an electronic device may be increased by using a communication device capable of radiating signals toward a plurality of planes.

According to various embodiments of the disclosure, the coverage of the electronic device may be increased with regard to a band ranging from 3 GHz to 100 GHz by radiating signals in the band ranging from 3 GHz to 100 GHz toward a plurality of planes.

According to various embodiments of the disclosure, as coverage directions of a communication device are increased, the degree of freedom may be increased with regard to a location where a communication device is mounted in the electronic device.

In addition, a variety of other effects directly or indirectly understood through this disclosure may also be provided.

While the disclosure has been shown and described with reference to various embodiments thereof, it will be understood by those skilled in the art that various changes in form and detail may be made therein without departing from the spirit and scope of the disclosure as defined by the appended claims and their equivalents.

What is claimed is:

1. An electronic device comprising:

a housing comprising a first plate, and a second plate facing away from the first plate;

a display configured to be viewable through a portion of the first plate and positioned in the housing; and an antenna structure positioned in the housing, wherein the antenna structure comprises:

a first printed circuit board (PCB) including a first surface facing a first direction, a second PCB including a second surface facing a second direction different from the first direction, a flexible PCB (FPCB) extended between a first periphery of the first PCB and a second periphery of the second PCB, at least one first conductive pattern formed in the first PCB or on the first surface, at least one second conductive pattern formed in the second PCB or on the second surface, at least one wireless communication circuit mounted on at least one of the first PCB or the second PCB, and configured to transmit or receive a signal having a frequency between 3 GHz and 100 GHz, at least one conductive line electrically connecting the at least one wireless communication circuit and one of the first conductive pattern or the second conductive pattern and disposed in the FPCB, and at least one third conductive pattern disposed in the FPCB and electrically connected with the at least one wireless communication circuit.

2. The electronic device of claim 1, wherein the first surface faces the second plate.

3. The electronic device of claim 2, wherein the first direction is substantially perpendicular to the second direction.

4. The electronic device of claim 1, wherein the at least one third conductive pattern is a metal pattern formed on the FPCB.

5. The electronic device of claim 1, wherein the at least one third conductive pattern is formed in a fill cut region of the FPCB.

6. The electronic device of claim 1, wherein the first PCB and the second PCB comprise a plurality of layers, and wherein the FPCB comprises layers corresponding to at least a part of the plurality of layers.

7. The electronic device of claim 1, further comprising:

a third PCB interposed between the display and the second plate and parallel to the first PCB; and a communication circuit disposed on the third PCB and electrically connected with the at least one wireless communication circuit.

8. The electronic device of claim 1, wherein the at least one first conductive pattern and the at least one second conductive pattern comprise at least one patch antenna element, and wherein the at least one third conductive pattern comprises at least one dipole antenna.

9. An electronic device comprising:

a housing comprising a first plate, a second plate facing away from the first plate, and a side member surrounding a space between the first plate and the second plate and connected with the second plate or integrally formed with the second plate;

a display configured to be visually exposed through a portion of the first plate and positioned in the housing;

an antenna structure positioned in the housing, wherein the antenna structure comprises:

a first planar structure facing the second plate, wherein the first planar structure comprises a plurality of first conductive plates formed therein or thereon, a connection part, a first end of which is bent and extended toward the side member from one end of the first planar structure, wherein the connection part comprises at least one third conductive plate formed therein or thereon, a second planar structure facing the side member and connected with a second end of the connection part which is opposite to the first end, wherein the second planar structure comprises a plurality of second conductive plates formed therein or thereon, and at least one wireless communication circuit electromagnetically connected with the plurality of first conductive plates, the plurality of second conductive plates, and the at least one third conductive plate, and configured to transmit or receive a signal having a frequency between 3 GHz and 100 GHz.

10. The electronic device of claim 9, wherein the connection part is different from the first planar structure and the second planar structure in at least one of a thickness, a number of layers, a flexibility, or a curvature.

11. The electronic device of claim 9, wherein the first planar structure includes a first printed circuit board (PCB), wherein the second planar structure includes a second PCB, and wherein the connection part includes a flexible PCB (FPCB).

12. The electronic device of claim 9, wherein the at least one third conductive plate is a metal pattern formed on the connection part.

13. The electronic device of claim 9, wherein the at least one third conductive plate is positioned in a fill cut region of the connection part.

14. The electronic device of claim 11, wherein the first PCB and the second PCB comprise a plurality of layers, and wherein the FPCB comprises layers corresponding to at least a part of the plurality of layers.

15. The electronic device of claim 9, wherein the at least one third conductive plate is electrically connected with at least one feeding line through a via hole.

16. An electronic device comprising:

a housing forming an exterior of the electronic device and comprising:

a front surface, a back surface facing away from the front surface, and a side surface surrounding at least a portion of a space between the front surface and the back surface; and a communication device comprising:

a first antenna array disposed to face the back surface, a second antenna array disposed to face the side surface, and a third antenna element group interposed between the first antenna array and the second antenna array and formed in a shape of a curve having at least one curvature, wherein the first antenna array comprises a plurality of first antenna elements, wherein the second antenna array comprises a plurality of second antenna elements, and wherein the third antenna element group comprises at least one third antenna element.

17. The electronic device of claim 16, wherein the first antenna array is formed on a first printed circuit board (PCB) or in the first PCB, wherein the second antenna array is formed on a second PCB or in the second PCB, and wherein the third antenna element group is formed on a flexible PCB (FPCB) or in the FPCB.

18. The electronic device of claim 17, wherein the FPCB is different from the first PCB and the second PCB in at least one of a thickness, a number of layers, a flexibility, or a curvature.

19. The electronic device of claim 18, wherein the at least one third antenna element is a metal pattern formed in a fill cut region of the FPCB.

20. The electronic device of claim 16, wherein the first antenna array is configured to radiate a signal in a first direction, wherein the second antenna array is configured to radiate a signal in a second direction substantially perpendicular to first direction, and wherein the third antenna element group is configured to radiate a signal in a direction different from the first direction and the second direction.

* * * * *